US006224387B1

(12) United States Patent
Jones

(10) Patent No.: US 6,224,387 B1
(45) Date of Patent: May 1, 2001

(54) PICTORIAL TOUR PROCESS AND APPLICATIONS THEREOF

(76) Inventor: Michael J. Jones, 38-B Carmella Dr., Gansevoort, NY (US) 12831

( * ) Notice: Subject to any disclaimer, the term of this patent is extended or adjusted under 35 U.S.C. 154(b) by 0 days.

(21) Appl. No.: 09/502,173

(22) Filed: Feb. 10, 2000

Related U.S. Application Data

(60) Provisional application No. 60/119,706, filed on Feb. 11, 1999.

(51) Int. Cl.[7] ..... A63B 69/36

(52) U.S. Cl. ..... 434/252; 434/247; 434/307 R; 473/131; 473/169; 473/409

(58) Field of Search ..... 434/247, 252, 434/257, 131, 307 R, 308, 365; 473/17, 131, 168, 169, 407, 409, 453; 463/29, 16, 40–42; 340/311.1; 380/251; 455/456, 566, 567; 342/21, 42, 44, 125, 127; 396/2; 700/91; 705/1, 17, 26, 27, 35, 36; 707/10, 103, 104; 709/201, 202, 217–219, 236, 250; 713/180; 725/37, 110, 134

(56) References Cited

U.S. PATENT DOCUMENTS

| | | | | |
|---|---|---|---|---|
| 5,523,737 | | 6/1996 | Luna . | |
| 5,664,115 | | 9/1997 | Fraser . | |
| 5,684,969 | | 11/1997 | Ishida . | |
| 5,732,398 | | 3/1998 | Tagawa . | |
| 5,740,549 | | 4/1998 | Reilly et al. . | |
| 5,760,771 | | 6/1998 | Blonder et al. . | |
| 5,762,561 | * | 6/1998 | Zine | 473/131 |
| 5,768,382 | * | 6/1998 | Schneier et al. | 380/251 |
| 5,774,878 | * | 6/1998 | Marshall | 705/35 |
| 5,793,740 | | 8/1998 | Nguyen . | |
| 5,794,207 | | 8/1998 | Walker et al. . | |
| 5,809,247 | | 9/1998 | Richardson et al. . | |
| 5,810,680 | * | 9/1998 | Lobb et al. | 473/407 |
| 5,816,918 | * | 10/1998 | Kelly et al. | 463/16 |
| 5,868,578 | * | 2/1999 | Baum | 434/247 |
| 5,904,484 | * | 5/1999 | Burns | 434/252 |
| 5,930,474 | * | 7/1999 | Dunworth et al. | 709/217 |
| 5,984,684 | * | 11/1999 | Brostedt et al. | 434/252 |
| 6,021,433 | * | 2/2000 | Payne et al. | 709/219 |
| 6,035,304 | * | 3/2000 | Machida et al. | 707/104 |
| 6,055,512 | * | 4/2000 | Dean et al. | 705/17 |
| 6,062,991 | * | 5/2000 | Moriarty et al. | 473/407 |
| 6,067,039 | * | 5/2000 | Pyner et al. | 342/125 |
| 6,074,312 | * | 6/2000 | Lyon et al. | 473/409 |
| 6,085,195 | * | 7/2000 | Hoyt et al. | 707/10 |
| 6,091,956 | * | 6/1998 | Hollenberg | 455/456 |

OTHER PUBLICATIONS

G. McCord, "Golf for Dummies", (IDG Books Worldwide 1999), Chapter 18, "Golf Online," pp. 311–328.

* cited by examiner

*Primary Examiner*—Joe H. Cheng
(74) *Attorney, Agent, or Firm*—Jonathan A. Bay

(57) ABSTRACT

A pictorial tour process acquires material for producing pictorial tours from given amusement venues and then publishes those pictorial tours on an Internet website so the web users can get a "you are there" perspective of the given amusement venue. In particular as applied to the game of golf, a golf website presents pictorial tours of various golf courses by means of shot-by-shot teachings from a player's perspective of the recommended play of a given hole. Such a shot-by-shot teaching tour entertains, teaches as well as allows a web user to judge whether the given course is attractive or suitable to that user. The web users get to see not just the beauty and skill-challenge of the course, but also check such factors as whether the course will adversely challenge to their health if they have conditions of, eg., weak heart or impaired walking mobility, or otherwise cause discomfort because of eg., desert heat or mountain coolness, and so on. Some course allow carts, others don't. Thus a hilly course up on a cool plateau is not likely appealing to someone who might be stricken by such things. Accordingly, that sort of "someone" ought to forego the course even if the beauty and skill-challenge aspects are otherwise appealing.

1 Claim, 19 Drawing Sheets

51
50

Narrative, 55(3)

[ Fig.3b ] Lake Placid Resort's Links Course' 18th hole, is a par 4 of 394 yards. [ Fig.3c ] The ideal Tee shot would be down the right-center of the fairway, which slopes right to left [ Fig.3d ].

[ Fig.3e ] The second shot would consist of a mid-to long-iron, to a slightly raised, relatively flat green [ Fig.3f ],... [ Fig.3g ].

[ Fig.3h ] The green has a sand bunker guarding the front left. All the danger is behind the green, due to the mounding right off the putting surface. This would leave you a difficult third shot to save par.

[ Fig.3i ] Any shot to the middle of the green would be a safe play, leaving you with a 20 to 25 foot birdie putt, from any pin placement [ Fig.3j ],... [ Fig.3k ].

Fig. 3a

PICTORIAL TOUR PROCESS AND APPLICATIONS THEREOF

CROSS-REFERENCE TO RELATED APPLICATION(S)

This application claims the benefit of U.S. Provisional Patent Application No. 60/119,706, filed Feb. 11, 1999.

BACKGROUND OF THE INVENTION

1. Field of the Invention

The invention generally relates to pictorial tour process (es) and applications thereof. In comparably general terms, the invention relates to a product comprising a pictorial tour which can be reckoned as still and/or motion pictures as well as an optional accompanying audio track (eg., inclusion of the audio track is preferred).

The invention includes the provision of diverse venues for the viewing (eg., playback) of such pictorial tours for amusement, teaching, coaching and training. Inventive aspects hereof include the provision of such a venue(s) as one or more wide area servers (eg., web servers on the Internet) which enable relatively wide area network-like dissemination and/or distribution of a given pictorial tour to diverse remote clients at diverse remote locations. A complimentary inventive aspect hereof includes the provision of relatively local area servers which enable the viewing of a given pictorial tour in a relatively specific locality which likely is proximately where the given pictorial tour was recorded. An example of this is the "electronic caddy" use of a golf course pictorial tour in accordance with the invention.

Other aspects of the invention relate to the production of the pictorial tour product. Processes are described which allow acquisition of views both on the ground and also at some given elevation above the ground. Such diverse vantage points are desired to provide such substantive content with the views as to support various instructional, educational, and/or entertainment enterprises and so on, which enterprises shall offer the pictorial tours as a lead or way-of-attracting a given consumer group into giving attention to the offerings of the enterprise. Another aspect of the invention relates to the structure of such enterprises which incorporate the advantages of the inventive pictorial tours.

A number of additional features and objects will be apparent in connection with the following discussion of preferred embodiments and examples.

2. Prior Art

Some understanding of the context of the invention can be reckoned in part by making an analogy to FM radio. Briefly stated, in FM radio, competing radio stations in a given listening area compete with each other for audience. Music-playing FM radio stations appear to establish a niche for themselves by staking their distinctiveness on a given music format. In doing so, such radio stations often advertise this fact on their broadcast. And so, perhaps some of us have encountered in the past this kind of a radio advertisement:—eg., '. . . rival radio-station X plays Music which is too hard, and rival radio-station Z plays music which is too soft, but we play music which is just right . . . .'

Furthermore, this kind of advertisement might include samples of music that is 'too hard' and 'too soft.'The music which is 'too hard' might be represented by shrieking noisiness. The music which is 'too soft' might be represented by elevator music. Immediately following those samples which the advertisement has sought to ridicule, the advertisement is likely to include a selection of music deemed (arbitrarily needless to say) to be 'just right.'

Assuming arguendo that many of us are familiar with FM radio advertisements of that kind (if not, the foregoing example is simple enough), the point of the analogy is this. Competing FM radio stations commonly seek to establish a niche for themselves in their market by their music formats. They choose and/or cultivate their niche by design. They advertise their niche on their broadcasts. They research who their audience is and what kinds of songs keeps their audience tuned in. They attract paying-sponsors based not just on size but more significantly the composition of the audience that such a niche or music format evidently appeals to.

To get back to how this relates to the invention, on the Internet nowadays there is getting to be a crowded field of competitors with websites on golf and golf courses. Many of these compete directly with one another for audience. Among these golf websites, one group can be characterized as the home sites for individual golf courses. Typically, a golf-course home site posts various pictures of its course, facilities and grounds. The pictures are typically beauty shots of the landscape or certain monster holes.

Much else found on the prior art golf websites is sales and hype. The course-owned websites naturally concentrate on hyping their courses. To be fair, they do include views of stunning scenery. In other ways, the advertising is more overt. Enticements and hype is included meant to work emotional appeals on the audience. The hoped for result might have the audience conjuring up fantastical expectations. But most people recognize hype and sales-puffing as such. It triggers alarms. It repels people in some cases, in others it has the audience wary that sales-puffing and hype are not truly reliable sources of unbiased information.

There are also golf channels which run programs—not necessarily free of sales-puffing and hype—but instead can characterized by their "talk" format. A lengthy program might have a host talking on and demonstrating such a single-minded matter as, for example, the non-flat clubfaces on drivers. Such a program might actually be an extended advertisement for the given driver, the sponsor, or the host's golf-lesson school. Other subjects for the golf channels are the PGA tour, and the unfolding of the action of a PGA tournament while it is underway.

None of the foregoing is preferable for the recreational player who wishes to research the shot-by-shot play of a given golf course for the sake of planning a visit or vacation. What is needed is an improvement which overcomes the shortcomings of the prior art and affords a pictorial tour website that allows web-users/recreational-level players to research the different venues on the website database with pictorial tours that are relatively concise and uncluttered by extraneous material.

SUMMARY OF THE INVENTION

What is provided by the present invention—in particular as applied to the game of golf—is a golf website which presents pictorial tours of various golf courses by means of shot-by-shot teachings from a player's perspective of the recommended play of a given hole. Such a shot-by-shot teaching tour affords a web user opportunities to be entertained and/or make an informed choice, relatively free of the influence of overt advertising, whether to visit the course immediately or consider it again another time.

The inventive pictorial tours are provided by a website of an Internet domain under the authority of a given service bureau. The service bureau is situated as an intermediary party between golf course owners on one hand, and web-users/golf-players on the other hand. The service bureau balances the interests between the courses and the users. The users are reliant on the service bureau for tours which conform to the service bureau's standard of quality. The permission of a golf course for inclusion on the website should not come at the price of subversion of that standard of quality. Hence the service bureau sets standards or protocols governing the format of the tours. One of the service bureau's functions is publishing tours which conform that format. Consistency has its own separate value. The service bureau "sells" its format to golf courses as good business for them (ie., the golf courses). That is, a shot-by-shot teaching tour from a player's perspective is valuable promotion nevertheless, even if overt advertising messages are excluded. Users can utilize the golf web site as a grand business directory which is informative, instructional and entertaining at the same time. The consistency of format for tours fosters familiarity which ought to encourage repeat traffic among the user audience.

The website further provides users with processes which allow online the making of travel and lodging reservations, tee time reservations, and check the current and forecasted weather for the golf course.

These and other aspects and objects are provided according to the invention in a method of informative amusement with a website database containing a pictorial tours of holes of different amusement venues as, for example, golf courses. The method optionally involves some of the following steps.

A website is provided with a database having a plurality of pictorial tours, wherein each pictorial tour features one hole of a golf course, the database having pictorial tours of multiple holes of diverse golf courses. There are users having machines for implementing a web browser and allowing selective playback of the pictorial tours. These users can connect online to global computer information network for handling the transmissions between the website and the user's machine.

Pictorial tours are arranged as an episode for continuous play from a beginning to an end and featuring a single hole, each episode comprising a series of scenes sequenced together for automatic playback from beginning to end, which series of scenes are taken from a corresponding series of staging areas comprising at least:—one staging area around the tees looking down the target line over the fairway to a prospective first-shot target zone for the original shot off the tee, as from a player's perspective;—another staging area around the first-shot target zone looking either rearwards back to the tees or forward ahead to a second-shot target zone; and, a further staging area around the greens looking back up the fairway.

The user is allowed to choose which episode the user desires to playback vis-a-vis the user's machine and browser.

Given the foregoing, this allows the user informative amusement with playback of the given single-hole episode, the user being limited in the informative amusement with the given single-hole episode by the content such that the pictorial tour only gives evaluative information respecting the play of the hole by excluding promotional content for promoting the golf course as well as excluding golf-lesson content respecting general lessons on skills for playing the game of golf applicable to any hole, whereby the user is freed of extraneous content that diverges from informing the user respecting the strategy how to play the hole and so allows the user to see himself in the context of his play through the hole vis-a-vis playback of the episode.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIGS. 2*a* through 2*h* comprise a set of associated views such that FIG. 2*a* gives a narrative of an audio track as FIGS. 2*b* through 2*h* comprise the corresponding pictorial segments of a given pictorial tour in accordance with the invention, and in each of FIGS. 2*b* through 2*h* there is an area of the screen display in which the printed text of the narrative is scrolled there-through, wherein:

FIG. 2*a* recites the script for a pictorial tour of—for sake of example—hole 1 of the Links Course of Lake Placid Resort (ie., upstate New York), and in which the transitions of the series of views, starting with FIG. 2*b* and until FIG. 2*h*, are noted in brackets, FIG. 2*a* also including the banner of home page of the website that comprises the principal medium to date on which the pictorial golf course tours in accordance with the invention are published, FIG. 2*b* is a view from a staging area of about the blue tee, and looking down the fairway, straightaway to the green, FIG. 2*c* is a is a view from a staging area of about the midway point down the fairway, continuing to look down the remainder of the fairway to the green, FIG. 2*d* is a view from about the same staging area as FIG. 2*c* except turned around to look back up the fairway to the tees behind, FIG. 2*e* is a view from a staging area in the fairway about a short-iron's distance away from the green, and showing a player about to stroke a second shot at the green seen in the background, FIG. 2*f* is a view from a staging area left and in front of the green, partly to show a sand hazard along the left, as well as partly to get a low angle perspective of the green to display the warp of the green, FIG. 2*g* is a view from a staging area before the front fringe of the green, partly to show the well-groomed front fringe as well as partly to show the thick rough guarding the right and back of the green, FIG. 2*h* is a view from a staging area on the back fringe of the green to show the cup in the foreground as well as the inclining extension of the fairway all the way back up to the tees in the background;

FIGS. 3*a* through 3*k* comprise a comparable set of associated views as FIGS. 2*a* through 2*h*, and more particularly such that FIG. 3*a* gives the narrative for FIGS. 3*b* through 3*h* that comprise the corresponding pictorial segments of another given pictorial tour in accordance with the invention, and in each of FIGS. 3*b* through 3*k* there is an area of the screen display in which the printed text of the narrative is scrolled there-through, wherein:

FIG. 3*a* recites the narrative for the pictorial tour of, in this instance, the 18th hole of the Links Course from Lake Placid Resort (N.Y.), where again the transitions of the series of views, starting with FIG. 3*b* and until FIG. 3*k*, are noted in brackets, FIG. 3*b* is a view from a staging area of about the blue tee, as viewing the stretch of the fairway to a straightaway green, the vantage point being kept intentionally low to highlight a ditch in the foreground as well as the lateral tilt of the fairway, which tilts on angle that goes down from the right side to the left, FIG. 3*c* is a view comparable to FIG. 3*b* except showing a first player in his backstroke for his drive, FIG. 3*d* is a view comparable to FIG. 3*c* except showing a second player at the bottom of his downstroke, FIG. 3*e* is a view from a staging area in the fairway about a mid-iron's distance away from the green, of the second player about to stroke a second shot at the green that is in view in the background, FIG. 3*f* is a view from a staging area in about the right rear corner of the fringe of the green, looking diagonally across the green to the cup, FIG. 3*g* is a view from about the same staging area as FIG. 3*f* except turned about an ⅛-th of a turn counter-clockwise to look around back along the fairway to the tees far in the background, FIG. 3*h* is a view which returns to the staging area of FIG. 3*e*, and showing the first player this time, at stroking his second shot at the green in the background, FIG. 3*i* is a view which returns to the staging area of FIGS. 3*f* and 3*g*, and in the direction of FIG. 3*f*, showing a threesome of players studying their respective putts, FIG. 3*j* is a view comparable to FIG. 3*i* except zoomed in on the putting action of the second player from the left-front corner of the green, and FIG. 3*k* is another comparable zoomed-in view except of the first player putting to the cup from behind it;

FIGS. 6*a* through 7*b* are a series of related illustrations showing aspects of perspective, wherein:

FIG. 6*a* is a pictorial illustration of a landscape with perspective determinable only by a series of receding horizons;

FIG. 7*b* is a reduced scale version of FIG. 1 and on a comparable scale as preceding FIG. 7*a*, which returns the inclusion of the intermediary trees and water hazard to show the improvement in perspective when diagonal lines are provided across the landscape;

DETAILED DESCRIPTION OF THE PREFERRED EMBODIMENTS

Figure 1:
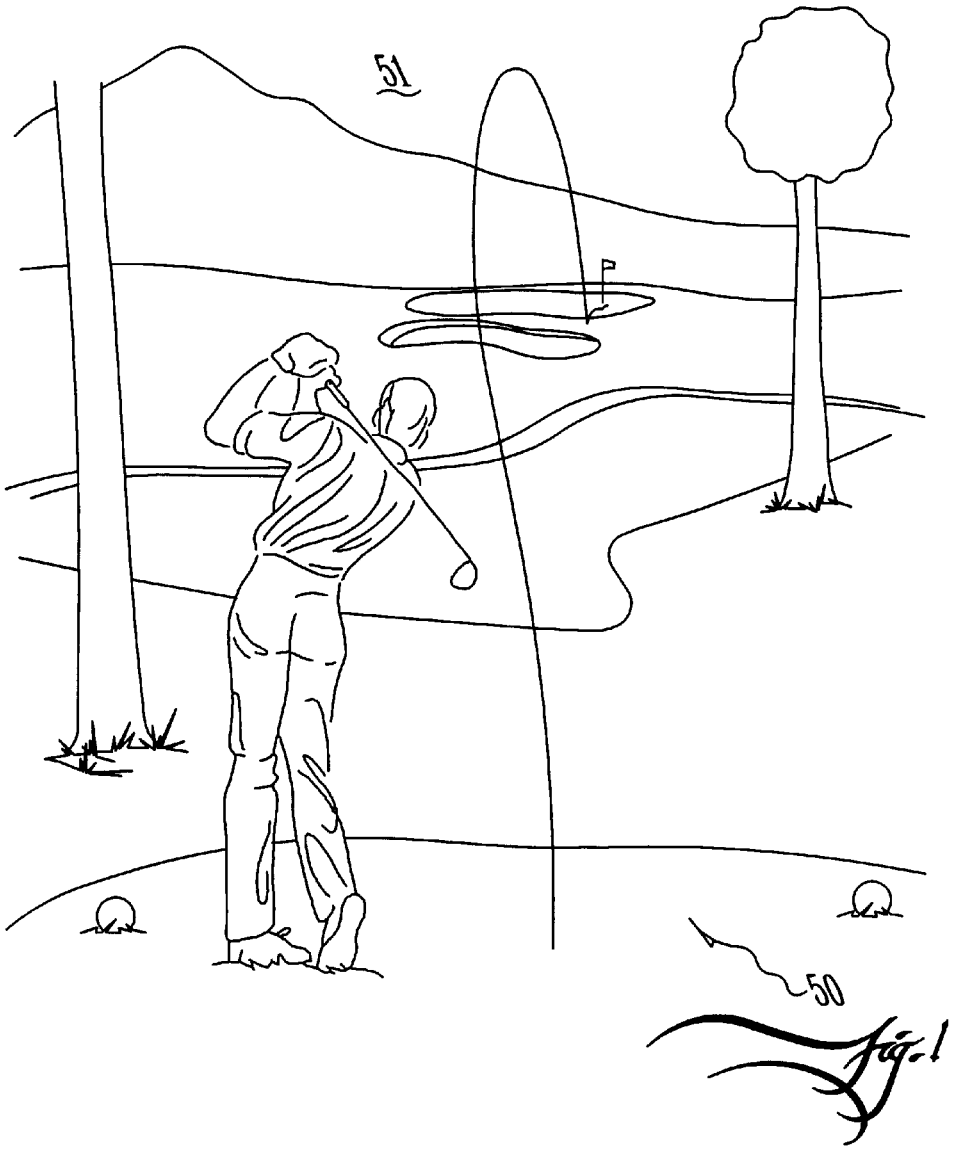
FIG. 1 illustrates a representative still image of a given pictorial tour wherein the game of golf exemplifies one example use application of the pictorial tour process in accordance with the invention.

FIG. 1 depicts a representative still image 51 of an example pictorial tour 50 in accordance with the invention. The game of golf provides one example application or field of use for the invention. The utilization of a golf pictorial tour 50 in the drawings here is done so for sake of convenience as practical "field or use" application for the invention but it does not, however, limit the applicability of the invention solely to golf. Whereas FIG. 1 is not truly a camera-captured image but instead an artist's illustration, it provides a useful basis for introduction to the pictorial tour process 40 (eg., FIG. 4) in accordance with the invention.

A "pictorial tour" 50 in the context of golf can be reckoned as at least one of three things. In a main or primary sense, a pictorial tour 50 of a golf course is a shot-by-shot teaching from a player's perspective of some or all of the holes of a golf course. For such shot-by-shot teaching tours 50, the cast of actors for the tours is usually the course pro plus one or more crew 110 members set out by the service bureau 60 to record the course 70 (see, eg., FIG. 4). The action is staged if need be to best bring out the salient features of the whole. The progress of the sequence of views 51 is not necessarily linear. The views may jump back and forth between far ahead (to look back) and then return to the ball position.

Two, an "event" pictorial tour 50' comprises website-served coverage of a competitive event. The action might be live, but at least an annotated version of the action will certainly be preserved in the website database 63 for users 80 to pull up at later times as they wish. "Event" pictorial tours 50' will begin some short time period ahead of the actual event. There will be course previews which will more nearly resemble the teaching tours 50 described immediately previously, except that there will be additional data served like player profiles on the competitors and the like.

Three, there are also tours 50" compiled from "user-submitted" material volunteered to the service bureau 60 which it, in its own discretion, may engineer and produce and publish as a "user-submitted" tour 50" on the website database 63. These user-submitted tours 50" are provided for their interest value as for everyone's mutual enjoyment and/or learning.

The tours 50 preferably are published on the Internet from a website 62, as will be more particularly described below in connection with FIG. 4. Touring is possible by several different ways. An Internet user 80 with a web browser can download tours to his or her own browser, provided that such Internet user has installed what to date are free plug-ins that can handle the interactive video and audio format of the tour 50. In the paradigm case, the Internet user 80 is imagined to be logged on the Internet from home, work or wherever with a remote device such as a personal computer, a laptop, or palm-type Internet capable machine with a link to the Internet by either copper lines or else radio and/or cellular links. It is presumed that the users 80 are exploring the inventive golf tour website 62 in their free time for planning a visit or vacation to the various golf courses provided by the "library" (or database 63) of the golf tour website. In extraordinary cases, the user 80 of the inventive pictorial tours might access the tours directly from the given golf course, using the tours in the sense of an "electronic caddy" mode of use 104 at the very instance of playing the golf course. Again, the foregoing will be more particularly described in connection with FIG. 4.

The tours preferably are originally recorded in digital format. Otherwise, film format material might be changed into digital format for storage on a computer-implemented storage medium, such as the website database 63.

Figure 4:
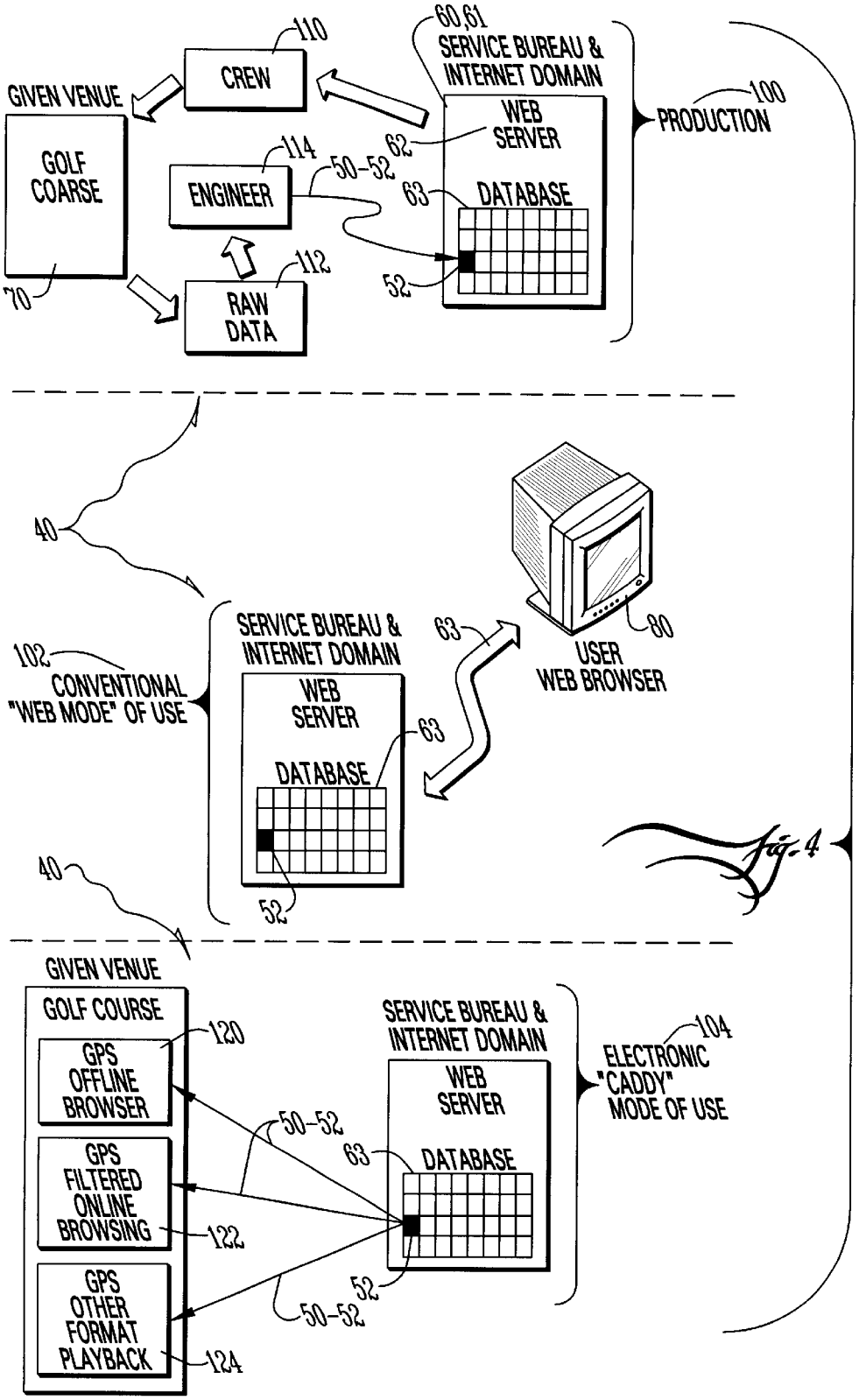
FIG. 4 is a schematic diagram view of various aspects of the production and use of a pictorial tour published on a web server wherein the upper frame shows aspects of production of the inventive content, the middle frame shows aspects of a conventional "wet mode" of use of the inventive content, and the lower frame shows an inventive "electronic caddy" use of the inventive content.

The tours are produced and published under the oversight of a given central tour authority 60 (again, eg., FIG. 4). In this description, the given central authority is most often referred to as the "service bureau". The service bureau 60 is responsible for establishing and operating the Internet domain 61 from which presumably one or more web servers 62 are used to serve the tours in web format.

The service bureau 60 is also an intermediary party who balances the interests of the rest of the community of interests involved in these pictorial tours. More particularly, in cases of the teaching tours 50, these involve the varying interests of the owners of the golf courses (eg., 70), the service bureau 60 itself, and the users 80 of the pictorial golf tours. In cases of event pictorial tours 50', further include the interests of the event promoters as well as the event competitors such as the professionals.

From the vantage point of the service bureau 60, one of its interests is to get as many golf courses 70 as possible in the database. That way, users 80 can simply resort to a single website (that being the domain 61 of the service bureau) for study and comparison of a group of golf courses, side-by-side one another, in reaching decisions which to visit or vacation at. The golf courses might not originally see this as advantageous since rival golf courses are also included on the database. Some golf courses may fear that the golf tour website 62 may divert business away rather than actually funnel business in. That fear is partly unjustified because the golf tour website 62 functions like an electronic business directory, just as the Yellow Pages is a paper business directory. Business directories likewise include the listings of rivals but such business directories also seem to serve the business interests of the listing parties nevertheless. Non-participation is more likely to result in more missed opportunities than any participation would ever lose.

However, unlike the Yellow Pages, the service bureau 60 and its golf tour website 62 is different. It no doubt is interactive, can be accessed from remote devices on a global computer information network from about anywhere on earth, and allows direct purchases or reservation-making.

Moreover, the service bureau 60 strives to level the playing field among the various participating golf courses in ways which the Yellow Pages does not. In the Yellow Pages, it's an open market. Those advertisers willing so spend the most get the most with little to constrain them in size and content of an advertisement. A high-spending advertiser might spend for a whole page on the back cover that is extravagantly designed, while a competitor might relinquish itself to relative anonymity in a simple telephone number listing. Also, the Yellow Pages advertiser is generally left to its own devices in designing its ad. Some advertisers wisely commission professionals who design effective ads. Other advertisers seem to come with ads that are embarrassingly uneffective.

In contrast with the Yellow Pages environment, the service bureau 60 situates itself as a moderator among the various participants. A high-spending golf course can have a high-budget tour prepared on every one of its holes, and from the most costly platforms available (eg., helicopter flyovers, IPIX 360° Pan-Zoom-Tilt views, audio tips &c.). Regardless, the most basic tour prepared at the lowest level of economy shall still benefit from the technical expertise and experience of the service bureau. That way, even an economy-budget tour shall compare favorably to a high-budget tour. All single hole tours will run about the same length of time. From the audience's view, the merits of any given tour are really about composition. In Hollywood, it is not a given that a mega-budget feature will automatically succeed over an independent's low budget flick. Broad popular appeal is not simply gotten by simply spending more. Composition and development continue to enjoy audiences. Just as movies seem to vary between about 90 and 210 minutes in length, so are the single hole tours similarly bracketed by arbitrary time limits.

Presently the inventor hereof prefers that a complete tour package 52 (see, eg., FIGS. 4 or 5) for a single course wind up around about ten (10) minutes long. For that to happen, this means that single-hole teaching-tours 50 run between about thirty (30) and forty (40) seconds in length.

Accordingly, the service bureau 60 levels the playing field among the various golf courses in various ways. Since simply spending a lot of money on production of a tour doesn't guarantee a widely appealing product, the courses are wise to rely on the services of the service bureau 60 which has expertise and experience in composing a tour showing a hole and course in the most favorable light. The service bureau's expertise is afforded to every participating golf course. The minimal inclusion would be a slide show (eg., a sequence of still images rather than video) of about three or four holes for every nine. The maximum inclusion might include aerial flyovers of every hole, other elevated views, plus moving video preferred over of still images for each segment of a tour, IPIX 360° Pan-Zoom-Tilt views and so on.

Thus in its role as moderator, the service bureau 60 implements policies or protocols (eg., 130 in FIG. 5) intended to mutually benefit the whole community of interests affected by its website tours. Ways which this works include the following. For various reasons, it has been decided that each tour 50 of a specific single hole ought to move along at a relatively breezy pace. The service bureau intends to disallow (or impede or otherwise discourage) inclusion of extraneous material that detracts from the shot-by-shot teaching format of the tour, from a player's perspective. Especially excluded will likely be overt emotional sales messages, especially the kind that in language use drippy superlatives which suggest or outright tell the user how he or she will "feel" (who knows how they'll actually feel) when playing the course. The service bureau 60 has decided to be obligated to its audience as any news-reporting bureau feels obligated in its profession:— that it ought to be objective with what is reported. In some instances the service bureau 60 might see itself free to present a viewpoint. But generally the service bureau 60 does not want to compromise or sell out its objectivity to the golf courses.

In cases of teaching tours 50, whereas the service bureau 60 does find itself selling its services to non-participating golf courses, the service bureau 60 is selling its professionalism and is not offering to sell out its independence. The teaching tours 50 will be covered by an audio track, including a scrolling caption of the script, which script is substantially technical, substantially concise and substantially concentrated on the matters regarding shot-by-shot play of a single hole and otherwise not tangential issues which might be distracting. If the golf course 70 wants more opportunity to advertise and to do so it length, the service bureau 60 will allow golf courses to put hyperlink buttons on the golf tour website 62 which lead to the golf course 70's own website (if it has one, not shown). At its own website (again, not shown), the golf course 70 is free to do what it wishes. But on the service bureau 60's main tours 50, the content will be relatively confined to format established in given protocols 130, and which are applied to every participating golf course 70. Aspects of this will be more particularly described in connection with FIG. 5 below.

In cases of event tours 50', reality is that the event promoters have the upper hand and it is likely to be them, the event promoters, who dictate how things will go.

To return to consideration of teaching tours 50, briefly stated, the teaching or technical information is preferably reckoned as a shot-by-shot teaching of playing a hole, from a perspective of a hypothetical player given an extraordinary opportunity to scout the hole. That extraordinary opportunity includes the opportunity to flyover the hole in a helicopter or else walk the hole back and forth—eg., from tee to green and back—one or more times as necessary to scout the salient features of the hole. This provides numerous advantages and benefits to users, including some of the following. It allows users 80 to decide what course to play, not just by seeing the beauty and skill-challenge but also, by checking such factors as the challenge to their health if they have health challenges (eg., weak heart or impaired walking mobility), discomfort in the elements (eg., desert heat or mountain coolness) and so on. Some course allow carts, others don't. Thus a hilly course up on a cool plateau is not likely appealing to, say, an advanced-age user who might weaken and sicken in such a place. Obviously, such an elderly user ought to forego the course even if the beauty and skill-challenge aspects were otherwise appealing. Much other information than that given in the foregoing will be subordinated to hypertext links that branch away from a main pictorial tour 50.

Figure 5:
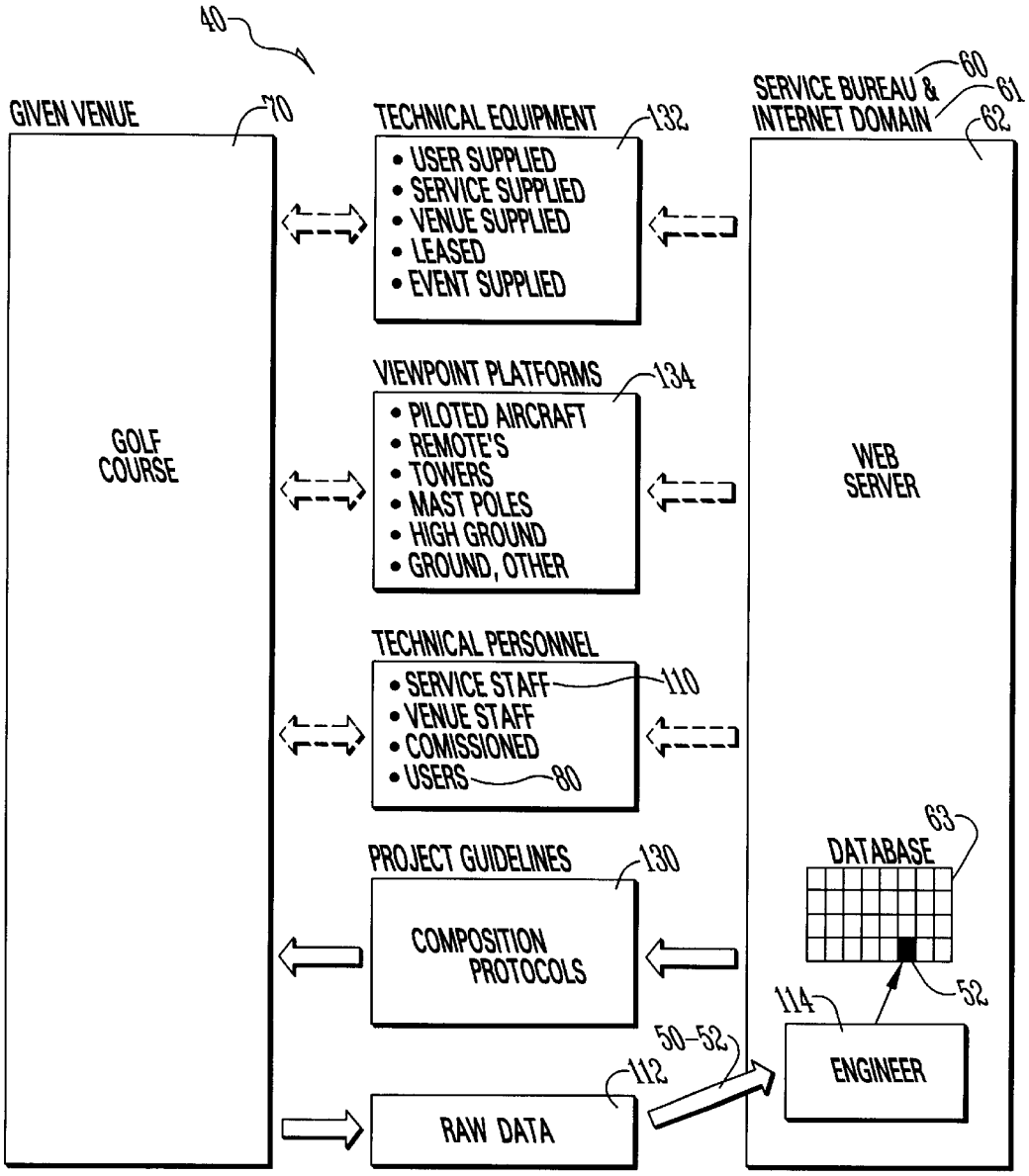
FIG. 5 is a schematic diagram view providing greater analysis of the production phase of pictorial tours in accordance with the invention.

Before dealing more particularly with FIGS. 4 and 5, it's time to look at a pictorial tour 50 in accordance with the invention by referring to the two non-limiting examples given by either the series comprising FIGS. 2*a* through 2*h*, or the series comprising FIGS. 3*a* through 3*k*.

Figure 2H:
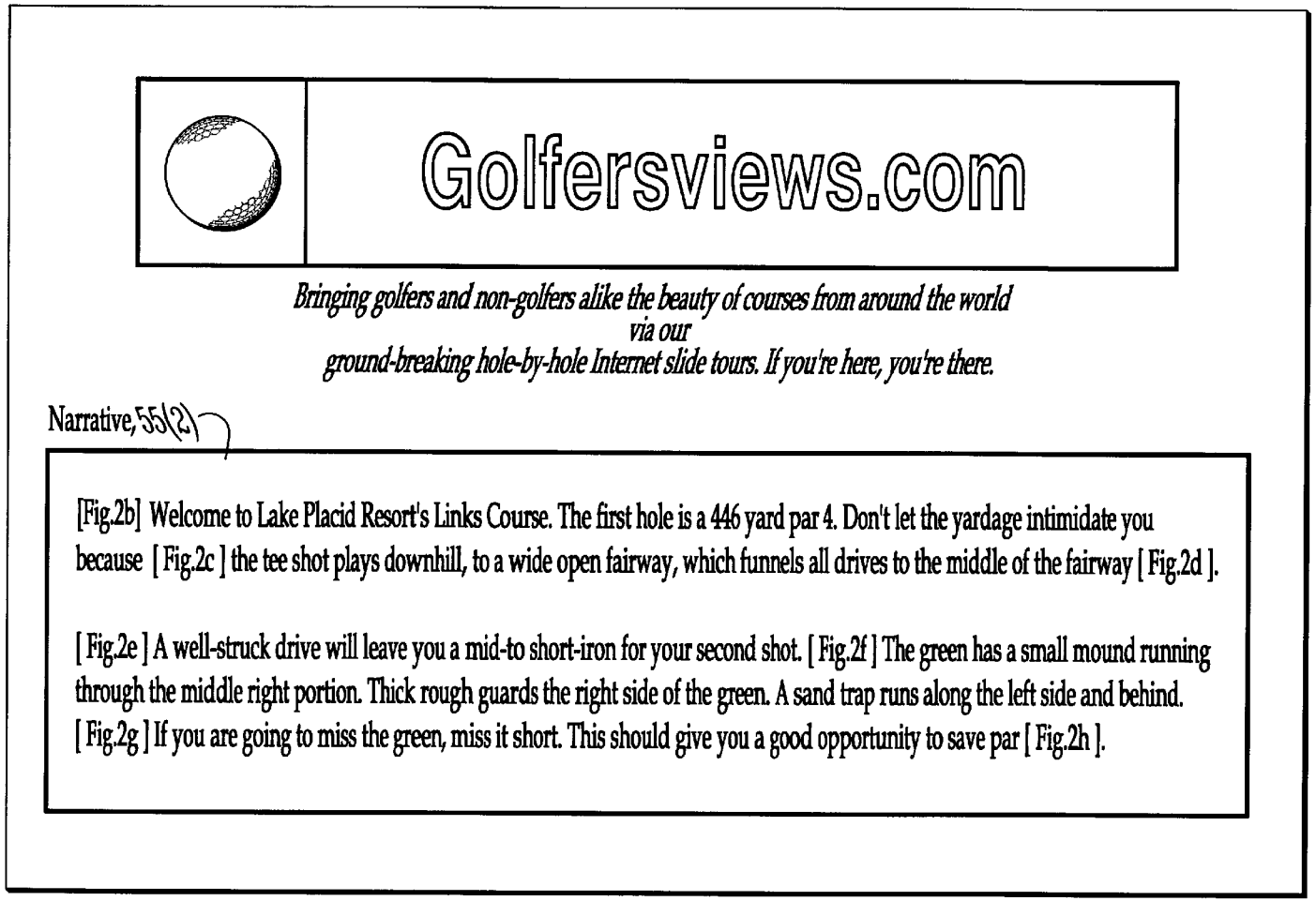

In the first example, FIGS. 2*a* through 2*h* comprise a set of associated views such that FIG. 2*a* comprises a script or narrative 55(2) of an audio track for the corresponding pictorial track that are shown by FIGS. 2*b* through 2*h*. In FIG. 2*a*, the script is narrated. Pauses are represented by paragraph breaks. The citations to FIGS. 2*b* through 2*h*, in sequence, represent the instances of transition between successive views. This pictorial tour covers an actual golf hole, ie., the first hole of the Links Course of the Lake Placid Resort, in upstate New York. An example website banner is also shown by FIG. 2.

In the drawings, a printed-format of the script text 55(2) is scrolled through a caption box on the screen display, as shown in each of FIGS. 2*b* through 2*h*. The tone of the narration is something like what is found among news anchors.

The sequence of views 51 in this case consist of a single "episode" 50(2). In general, an "episode" or tour 50 denotes a hole. Sets of episodes or tours 50 are bundled in packages (eg., FIGS. 4 or 5). This episode 50(2) has been prepared and produced by the service bureau 60. The episode runs automatically from a beginning (eg., FIG. 2*b*) to an end (FIG. 2*h*), unless the user intervenes. For example, the user 80 might intervene to pause, pan, back up, or click to purchase the image. If the user does not intervene, the episode might re-start and run again and again without stopping. This episode 50(2) lasts about thirty to forty seconds (30–40 sec), and as the website is presently set up, the episode will run endlessly in a cycle. However, this re-run mode can be varied such that the episode covering a given hole might succeed into a successive episode covering the next given hole in the succession.

Also, even though the examples of FIGS. 2*b* through 2*h* comprise still images, they might alternatively comprise action videos. Regardless, each episode 50 is likely composed of segments 51. A first segment might start around the tees. The later segments likely end up around the green. Even if action videos are used, a whole episode 50 is not likely to be composed a one instance of carrying the video camera down the fairway from tees to green. The action will jump from place to place. That way, even in cases of action videos, the episode 50 comprises segments 51 strung together.

The positions in which the camera(s) is(are) placed to get views are called "staging areas". For still images, the staging area comprise a single location from where the still image is captured. For action video, the staging area might encompass more territory as the camera is transported around to shoot, say, the green from the fringe as the camera operator wanders around a bit. Regardless, the jump in the action from the tees to the fairway, then to the fringe and after that onto the greens, is likely to involve stops in the action, to be restarted from a different staging area.

Figure 2B:
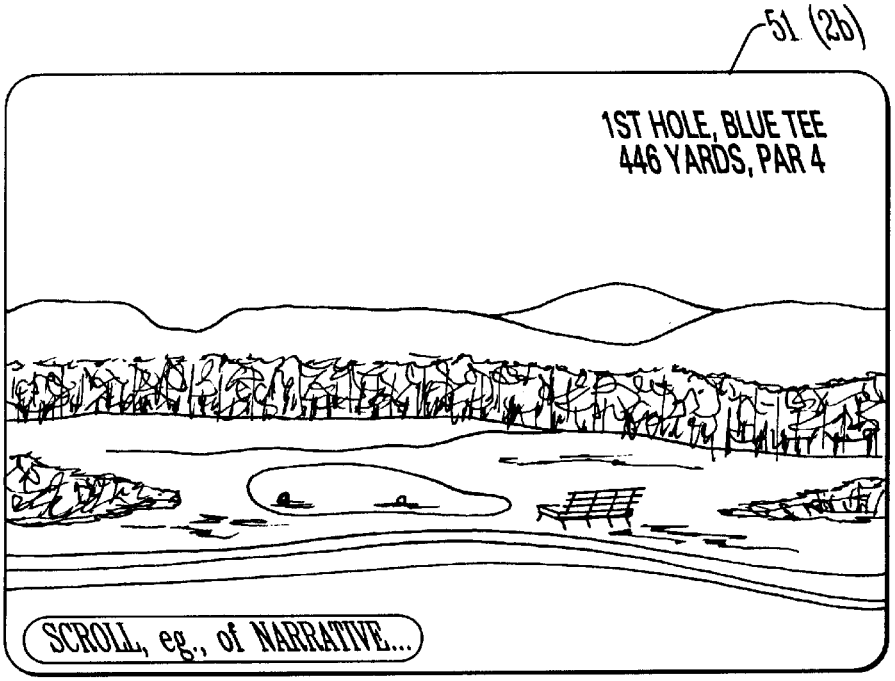

With that said, FIG. 2*b* is a view 51(2*b*) from a staging area that is located at about the blue tee for this hole. Graphics also inform the viewer of this fact also. The view is directed looking out over the stretching away fairway to the green which lies straightaway down a hill. This view provides a normal player's view of the fairway and green.

Figure 2C:
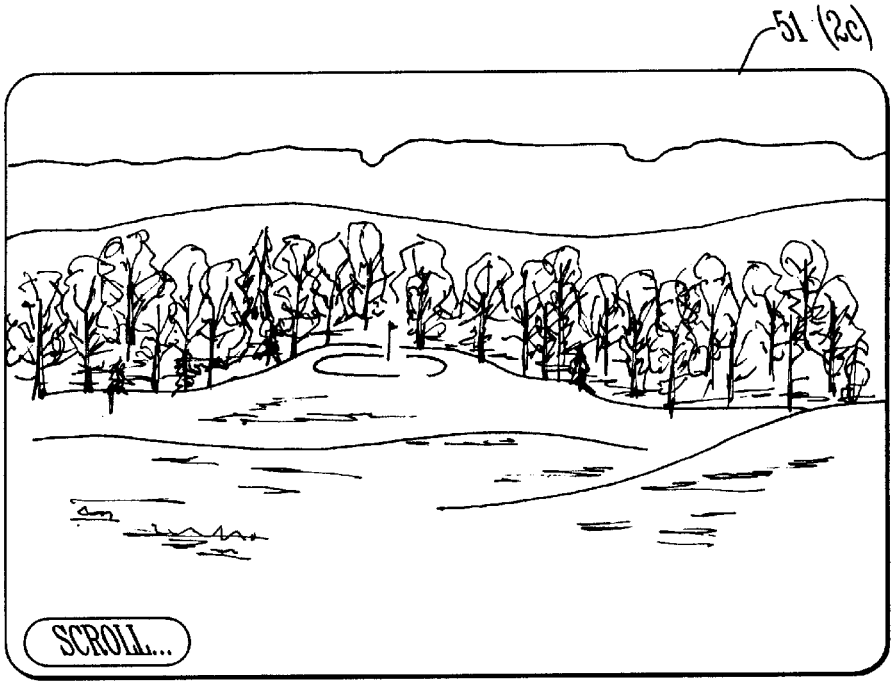
Figure 2D:
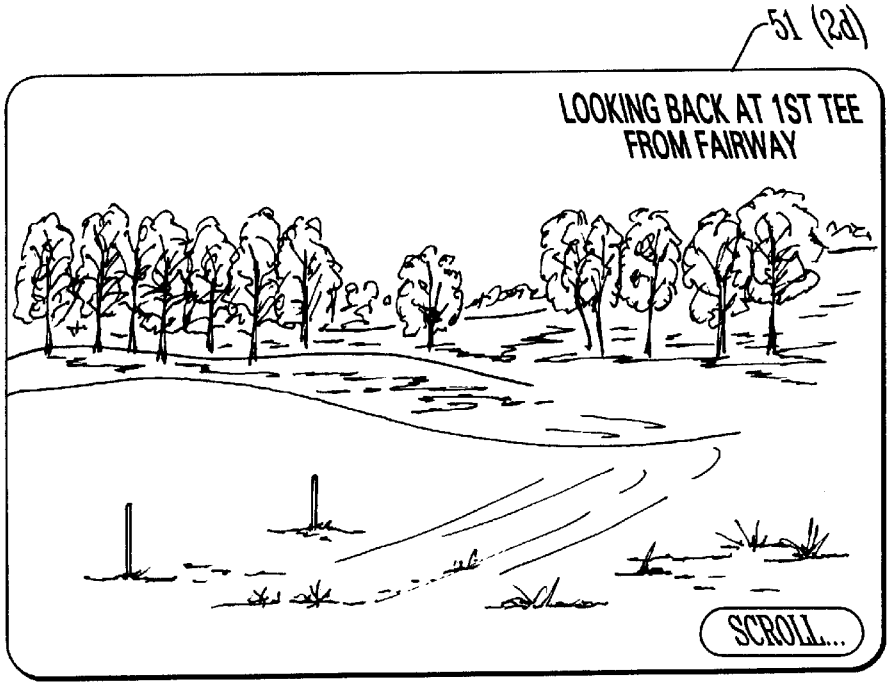

FIG. 2*c* is a view 51(2*c*) from a staging area of about the midway point down the fairway. The direction of the view is continuing to look down the remainder of the fairway to the green. It shows that the fairway is rather trough-shaped, and this helps funnel the first drive down the lane of this trough on its way to the green. Part of the power of the slide show is shown by FIG. 2*d*. From about the same staging area as FIG. 2*c*, the camera is turned around to look back up the fairway to the tee behind to get this view 51(*d*). From this the viewer can easily reckon the trough, as well as affirm the simplicity of the advised strategy (eg., as advised by the narrative) to utilize the trough and simply drive the ball so as not to land out of it.

Figure 2E:
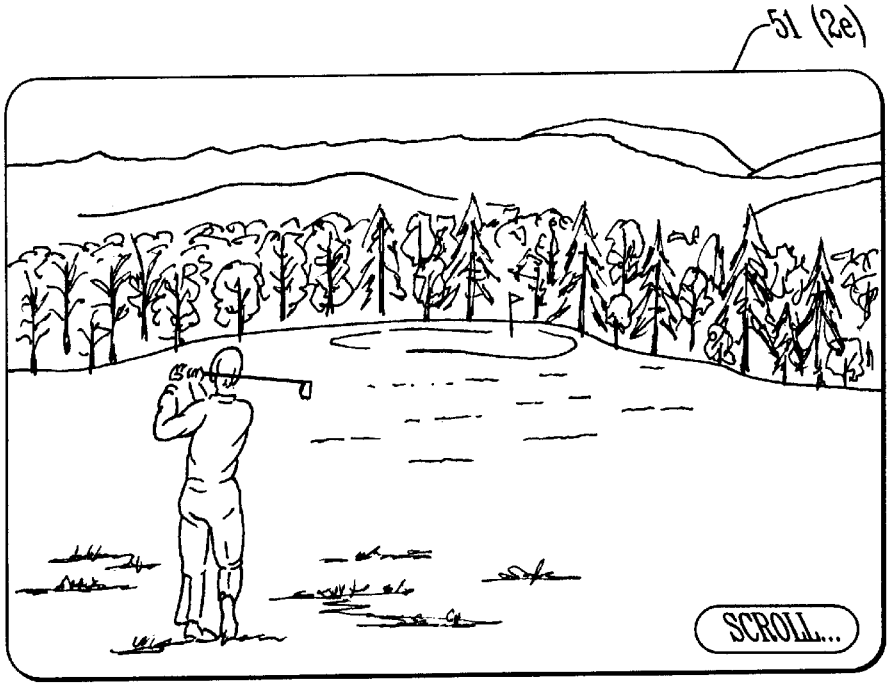

FIG. 2*e* is a view 51(2*e*) from a staging area in the fairway about a short-iron's distance away from the green. It shows a player about to stroke a second shot at the green seen in the background. For this view, because the camera operator is upslope, the camera is virtually set on the ground to get both the player and the green in the view field. This view is also an example of poor perspective, as explained more particularly in connection with FIGS. 6*a* through 7*b*. It can hardly be helped in this instance. That is why a diversity of views is so advantageous. For ball lies where the course does not provide a diagonal line or other basis for perspective's sake, perhaps a view from the target site looking back might give the absent perspective.

Figure 2F:
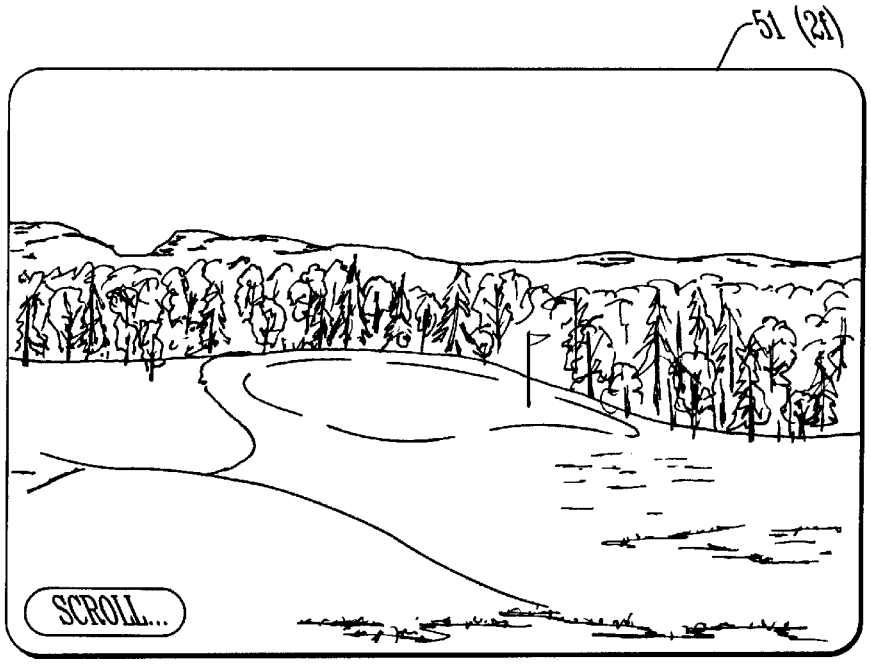

FIG. 2*f* is a view 51(2*f*) from a staging area in front of the green and to the left, partly to show a sand hazard along the left, as well as partly to get a low angle perspective of the green to display the warp of the green. In contrast to FIG. 2*f*, there indeed is a partial diagonal line which helps in reckoning depth. Sequencing into FIG. 2*g*, it is a view 51(2*g*) from a staging area near the front fringe of the green, partly to show the well-groomed status of the front fringe as well as partly to show the thick rough guarding the right and back of the green. FIG. 2*h* is a view 51(2*h*) from a staging area on the back fringe of the green to show the cup in the foreground as well as the extension of the fairway back up to the tees in the background. As was mentioned in connection with FIG. 2*e*, for this view too, the camera operator has again set the camera virtually on the ground in order to frame both the player and the upsloping fairway in the view field.

The above example pictorial tour allows further description of what "is" a pictorial tour 50 in accordance with the invention, and what it is not. The pictorial tour 50 is meant to supply a series of segments 51 that gives a user a "you are there", shot-by-shot teaching perspective of the golf hole. The accompanying narrative 55 provides strategic information on salient features of the hole that a player can then utilize to plan his or her own strategy for success on the hole. The "you are there" perspective is not exactly a player's shoulder-high perspective. The camera may be set on the ground or elevated high aloft, may even flown overhead. Also, the views 51 can sequence jumping around from staging areas at the tees, to the fairway, to the green, and then return right back at the tees if desired. Moving the viewpoints back and forth this way gives a better view of the course than is actually seen by a player striding it in a continuous forward direction.

Again, the views 51 may jump around such that a given view looks from a given ball placement down field in the direction of the target zone, then a succeeding view jumps to the target zone to look back at the ball placement to show better what the intervening terrain and/or slope looks like, to be followed by another view that switches back to the original given ball placement to show once again what the shot looks like from there. That way, a user 80 is likely to discern more detail in the forward-looking view after being given the benefit of a backward-looking view.

Also, not all the views 51 are taken from shoulder-high eye level. In some instances the camera was set on the ground. In others (especially as shown in the coming example of the 18th hole), the camera is elevated to give a downward angle from above tops of the heads of the players. Indeed, it is especially desirable to include aerial flyover shots where budget allows the acquisition of such shots. This aspect of the invention will be more particularly described in connection with FIG. 5. Therefore, briefly stated, the views 51 are chosen to provide a user 80 with a sufficient shot-by-shot study of the hole so that the user may gauge the challenge that any given hole will likely present that user. However, the study is preferably relatively brief. These are meant to be tours, not documentaries.

That leads to what the tours 50 are "not", which includes some of the following. For one thing, the tours 50 are not advertisements. Perhaps the tours 50 do provide favorable publicity for a given hole. But absent from the tours is the overt appeal to the audience to 'come test your skills on this course' or 'picture yourself here'. The guiding protocols 130 behind the production 100 of the tours 50 includes:—presenting in a direct and succinct manner the technical shot-by-shot features of the hole; doing so relatively objectively like news reporting; avoiding emotional appeals to such subjective intangibles as the 'thrill' or 'fun' to be had on the course; as well as not overstating the challenge of the hole and so on. Also, the tours 51 are given lots of movement but kept brief. The narratives 55 are excised of babble and so much of that talk that clutters up certain prior art golf channels.

The teaching tours 50 have inherent entertainment value. The courses have pride in their grounds and the teaching tours 50 accommodate this pride by framing the background to pull in beauty features. Such as, FIGS. 3*j* and 3*k* (and others) show the Olympic ski jumps in the background. Good backdrops for the pictures alone can induce users 80 to wish to be there.

It is preferred if there is an opportunity to include sidebars (not shown), but these shall not likely be incorporated directly into a main tour 50. That is, if some famous player played the hole exceptionally well, or perhaps the hole was the scene of some infamous disaster that is well known in golf lore, then such historical matter fits within the general protocol 130 scheme of the service bureau 60 but it might find itself shunted to a side bar. Side bars can be accessed by hyperlink branches that go to other short audio-visual pieces for that special coverage.

Also, the tours 50 do not provide lessons for general golf skills. To go back to a basic premise, the tours 50 do provide a shot-by-shot exploration of playing the hole. No single hole tour 50 is likely to include much in the way of lesson on general skills. There is a useful place for providing golf lessons via this inventive website. Doing that is best reserved for another area of the website and will be more particularly described in connection with FIG. 10. Hence a pictorial tour 50 in accordance with the invention preferably focuses on a thumbnail sketch of the salient features of a hole by means of a shot-by-shot teaching. It excludes things which divert away from the focus. The tour 50 automatically sequences before the user 80 a sequence of segments 51 that support the thumbnail sketch if not even facilitate the gleaning of more expert information by persons 80 having sharp eyes.

The rationale behind these choices include the following. It is believed that such a concise, quick-paced shot-by-shot teaching tour 50 can withstand watching and re-watching more than anything that contains excess. Advertisements seem to utilize a "hook" so as to grab the viewer. This is best avoided in the pictorial tours because the hook is tiring at best upon re-watching, and indeed might have the opposite effect of causing a user 80 to rebel against that hole and golf course. In brief, it is decided to avoid "pleas" in the pictorial tours. Advertising can be handled elsewhere, as perhaps in banners on the web page or in the links that branch away from the main tour 50 (but preferably not outside the website domain 61). However accommodated, Advertising is preferably excluded from the main teaching tours 50 proper. A main teaching tour 50 creates interest in the hole by virtue of the cascade of views 51 that sequence before the user 80, giving the user 80 a shot-by-shot teaching. Gratuitous golf lessons are likewise excluded from the shot-by-shot teaching tours, not only to keep the tours short but similarly to avoid tangential information tending to divert attention away from the shot-by-shot play of the hole itself. Golf skill instruction is handled elsewhere on the site 62.

Figure 3B:
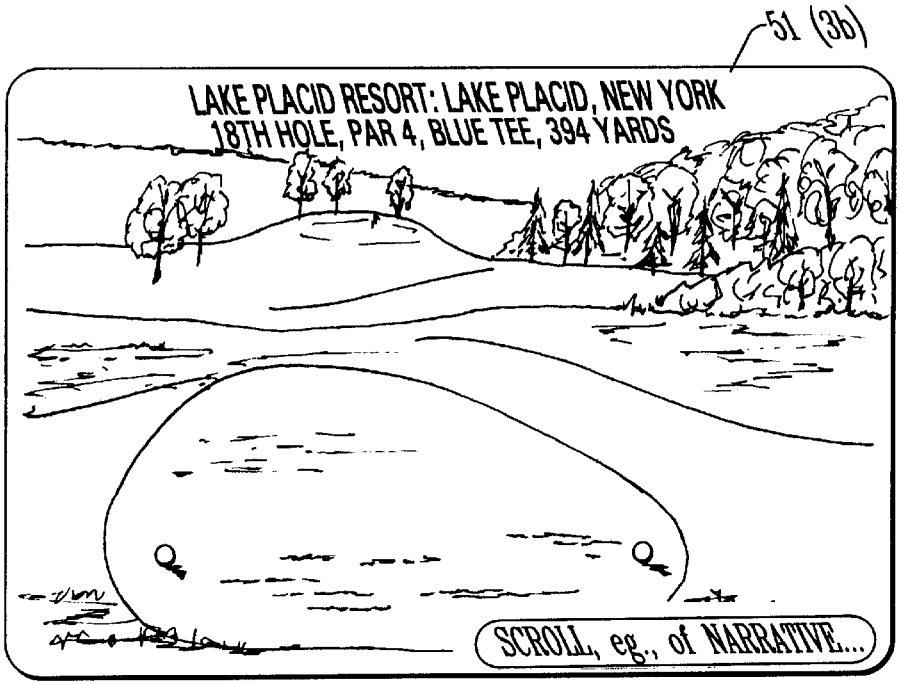

To turn to the second example, FIGS. 3*a* through 3*k* comprise a comparable set of associated views, this time of a tour 50(3) of the 18th hole of the Lake Placid Resort's Links Course. FIG. 3*a* gives the script for the narrative 55(3). This time the ellipses in FIG. 3*a* represent pauses during which one or more segments (ie., either stills or action video segments) sequence before the user 80. FIGS. 3*b* through 3*h* comprise the corresponding pictorial segments.

Figure 3C:
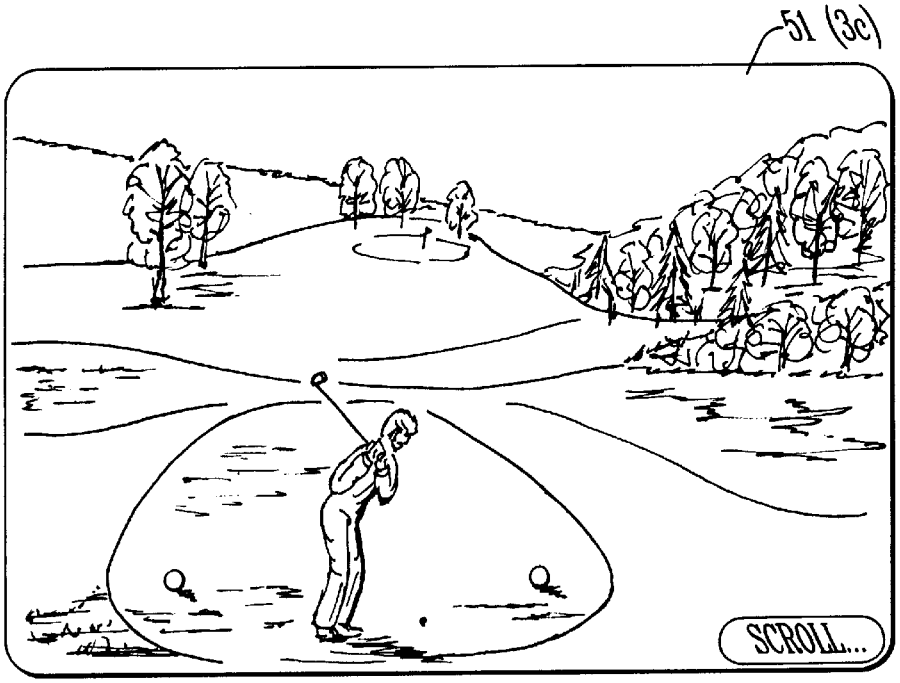
Figure 3D:
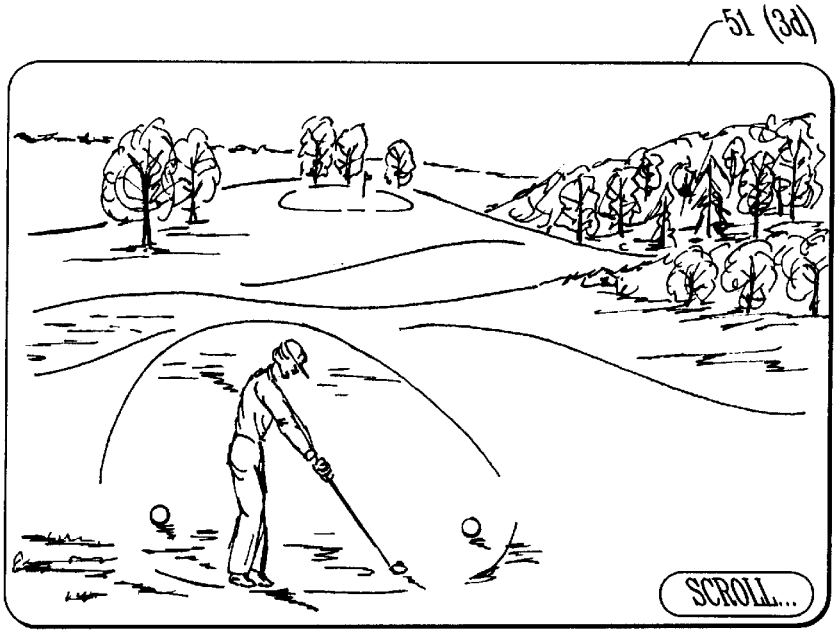

FIG. 3*b* is a view 51(3*b*) from a staging area of about the blue tee, and looking out at the stretching away fairway to a straightaway green. The vantage point is kept intentionally low to highlight the ditch in the foreground as well as to highlight the sideways tilt of the fairway, which tilts down sideways from right to left in the view. FIGS. 3*c* and 3*d* present views 51(3*c*) and 51(3*d*) comparable to FIGS. 3*b* except showing a first player in his backstroke for his drive and then a second player at the bottom of his downstroke.

Figure 3E:
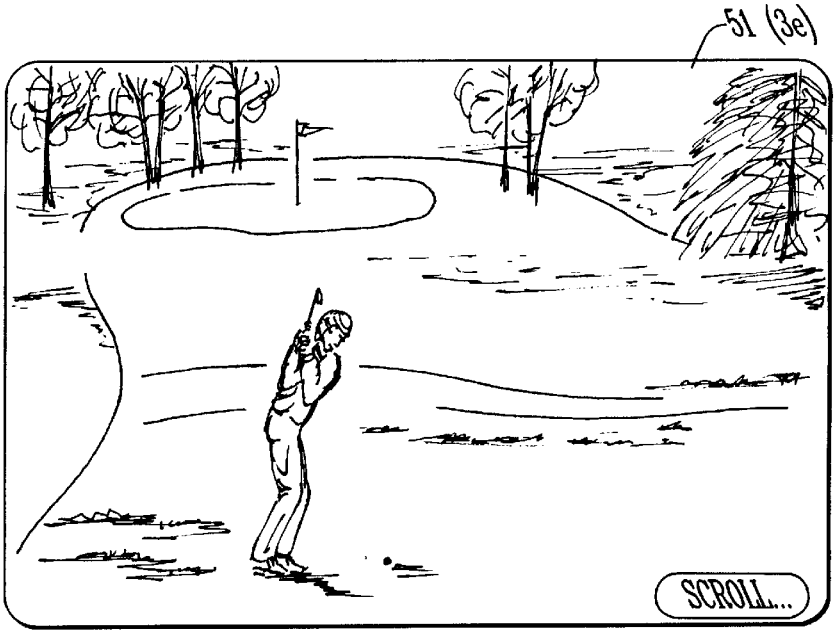

FIG. 3*e* is a view 51(3*e*) from a staging area in the fairway about a mid-iron's distance away from the green. This view 51(3*e*) shows the second player at about the time he contacts the ball for his second shot at the green. The green remains in view in the background. The vantage point for the camera is elevated. In fact, the camera is held aloft by being mounted on a mast or post that is being manipulated by an assistant. The camera operator stands on the ground beside the assistant. The camera operator views and focuses the camera by means of a remote viewfinder and control panel that is wired to the camera up above.

Figure 3F:
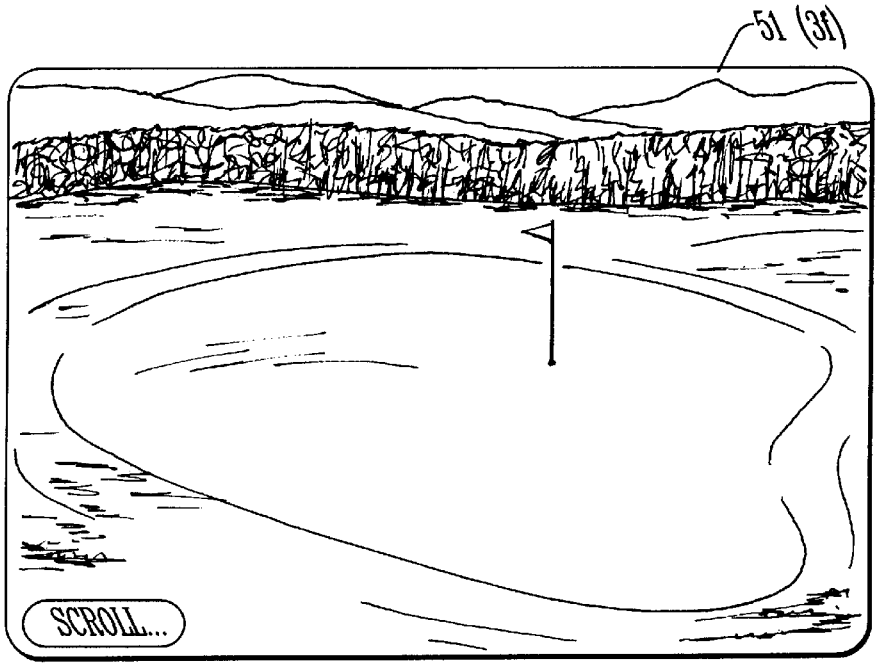
Figure 3G:
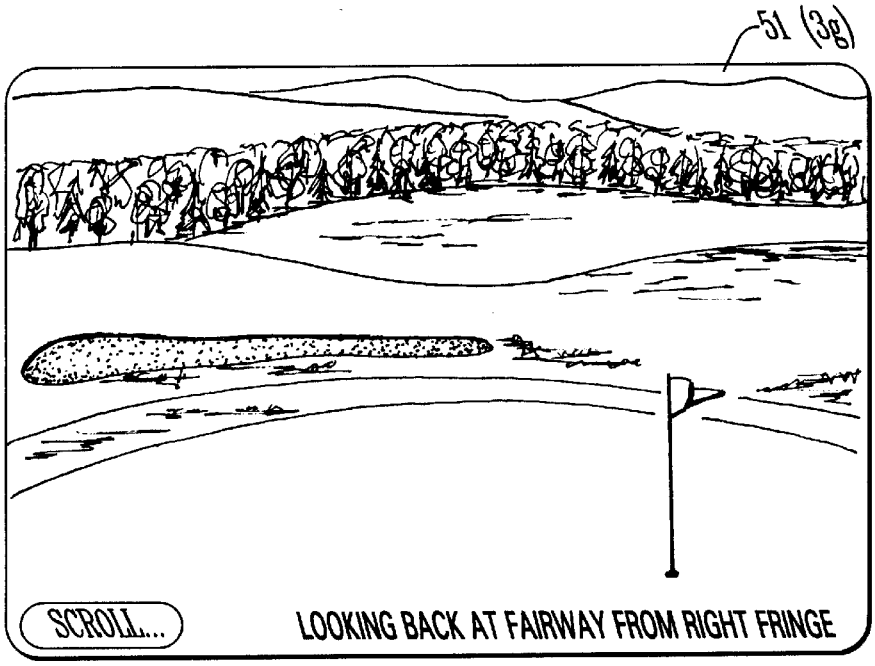

FIG. 3*f* takes a big jump. The view 51(3*f*) of FIG. 3*f* is taken from a staging area in about the right rear corner of the fringe of the green. The view is looking diagonally across the green to the cup. FIG. 3*g* is a companion view 51(3*g*), from about the same staging area as FIG. 3*f*. Here the camera is turned about an ⅛-th (eighth) of a turn counter-clockwise to look around back along the fairway to the tees far in the background. FIGS. 3*f* and 3*g* afford the user some landmarks to get his or her bearings on where the camera staging area is in relation to a player's approach from the fairway.

Figure 3H:
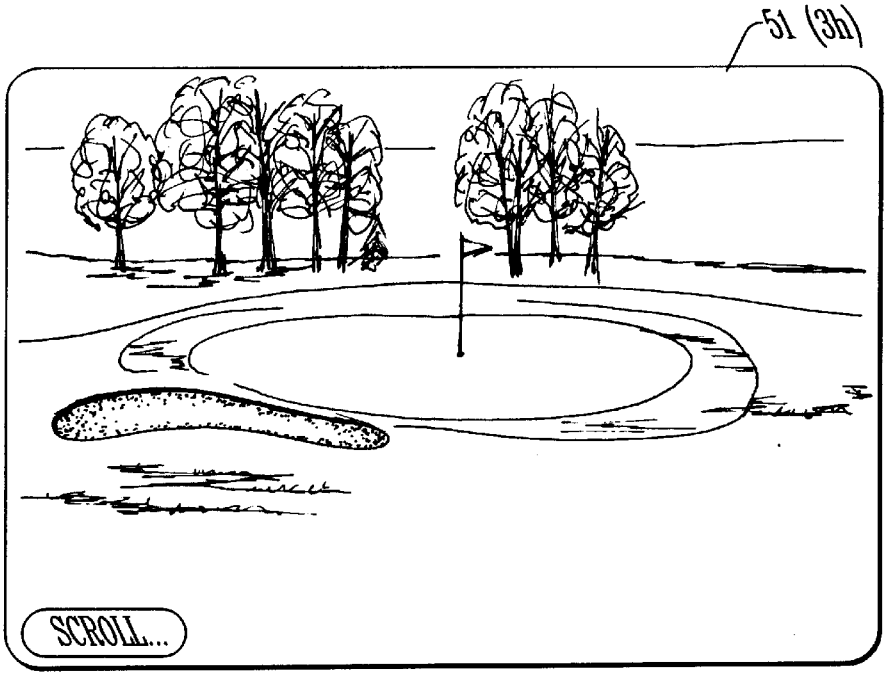

Next in sequence is FIG. 3*h*, a view 51(3*h*) which jumps all the way back to the second-shot ball placement, that being the same staging area as for FIG. 3*e* previously. Here the first player is shown stroking his second shot at the green. Now FIG. 3*i* leaps back again to the staging area of previous FIGS. 3*f* and 3*g*. In this view 51(3*i*) it can be seen that the pictorial tour 50(3) is not exactly a natural sequence of views gotten by merely walking the hole from tee to green. The views jump back and forth, looking ahead to a target and then giving a backward look from the target zone all for providing the most favorable pictorial treatment of the hole. Thus, while it is an object of the invention to give a user a "you are there" tour of the hole, in some ways the tour is better than actually being there. The views jump back and forth by what can amount to several hundred yards at a time. Most players are not afforded this luxury to so thoroughly scout a hole by reconnoitering it from both the ball placement, the landing zone, and then back to the ball placement. Also, since the views are taken from elevated positions, this also beyond most real-life experiences of actual players.

Figure 3I:
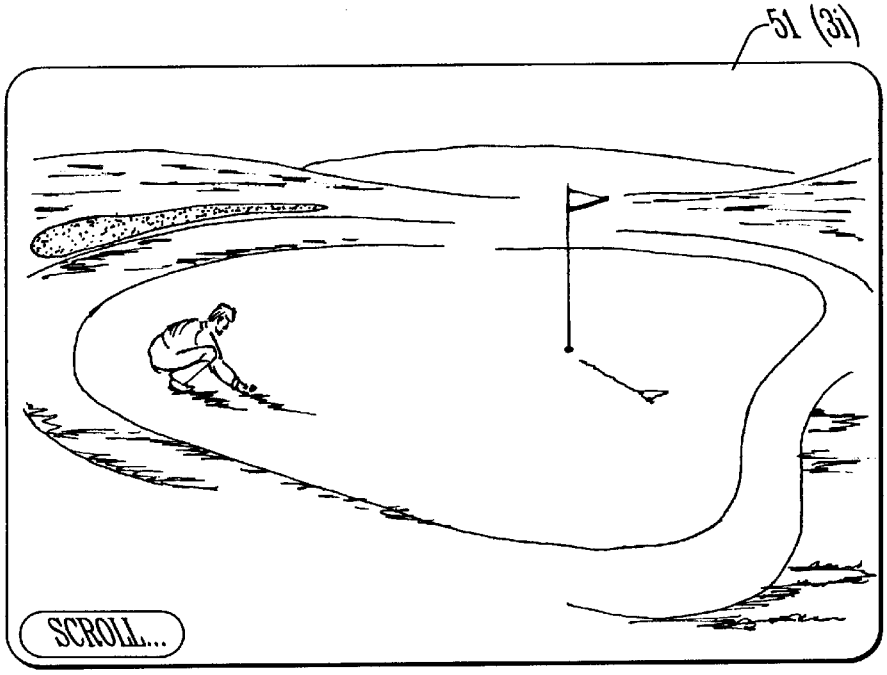
Figure 3J:
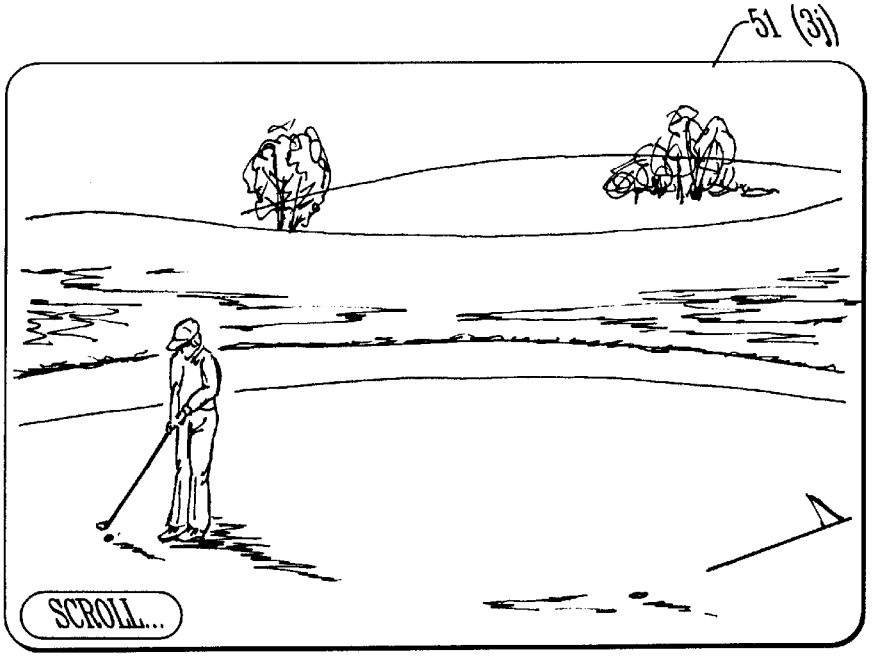
Figure 3K:
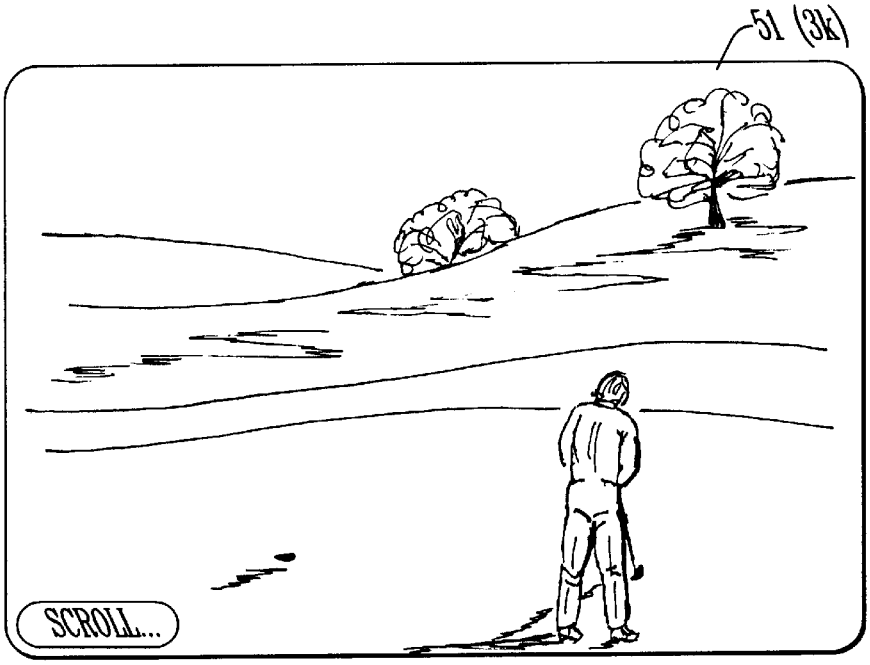

In FIG. 3*i*, three players are shown studying their respective putts. The succeeding view 51(3*j*) of FIG. 3*j* is zoomed in on the putting action of the second player who is putting from the left-front corner of the green. Successive view 51(3*k*) of FIG. 3*k* is further zoomed in on the first player while putting to the cup from behind it.

FIG. 4 shows aspects of the interactions among three parties, namely the service bureau 60, a representative given golf course 70, and various users 80 of the pictorial tours. In the "prior art" section above, an Internet golf site was likened to an FM radio station. That was done so for a limited purpose there in that section and for convenience in this description only. There are major differences. Take for example the following difference. If an FM radio station plays music for entertainment, it is the music that is the entertainment. The entertainment draws in an audience. The FM radio station sells advertisements to sponsors who want access to that audience. With the pictorial tour golf site in accordance with the invention, it is the pictorial tours of the golf course properties themselves that provide the entertainment. In brief, the sponsors are the entertainment.

Hence this requires much more cooperation between the service bureau and the sponsors. But for a service bureau which values its professionalism and independence, this cooperation if unguarded risks some loss of independence. The situation demands that service bureau stand strong in its commitment to its professional integrity.

In other words, the service bureau 60 has persuasive reasons for doing business the way it does. The service bureau 60 desires to persuade participating golf courses that its way of doing business is good for them. But the service bureau 60 also hopes to avoid interference from golf courses who want preferential treatment for themselves that might detract from the interests of earlier-joined participating golf courses. Problems can spiral after that with later-joining golf courses, who are likewise going to want the same preferential treatment gotten by the last-joining golf course if not also want to expand the envelope even greater for themselves.

FIG. 4 is divided into three frames. The frames generally denote events occurring at different times. The upper frame shows the inventive production phase 100 of an inventive tour. The middle frame shows a conventional "web mode" of use 102 of the inventive tours. The lower frame shows an inventive "electronic caddy" mode of use 104 of the inventive tours.

To review first the upper frame, it shows that the service bureau provides the crew 110 and expertise to acquire the raw material 112 for a pictorial tour. At a preliminary stage, the golf course owners commission the service bureau 60 to picture their golf course 70. The golf course 70 and service bureau 60 agree to how many holes shall be pictured, at what budget and so on. Based on those parameters and others, the crew 110 is sent to the golf course 70 to review it for recordation. To date this has involved a team of two or three. The crew plays the course with the staff pro and discuss the salient features of the pertinent holes. The crew 10 plans a set of staging areas to picture different action involved in shot-by-shot play of the hole as well as other salient features. Then the crew actually gets out the cameras and props, and takes the pictures. This makes up the raw material 112 of the tour. The raw material 112 is taken back to a studio as an engineering studio 114 or the like, and produced into a finished product. Perhaps the golf course 70 will be given a preview. Perhaps also, more raw material will be acquired to polish out the finished product. Ultimately the finished product comprises a package 52 of "tours" 50 of each of the included holes. The package 52 of that golf course 70 is stored on the database 63 of the website 62 as a given edition among many available in a virtual "library" (eg., database 63) of other like packages or editions covering other golf courses.

The middle frame shows conventional browser mode of use 102 of the website database 63. In the paradigm case, the Internet user 80 is imagined to be connected online to the Internet from home or work, spending some spare time exploring the inventive golf tour website 62 for planning a visit or vacation to the various golf courses. The "library" (or database) 63 of the golf tour website gives the user 80 many packages or editions 52 to browse. The user can browse and browse online without end.

When online, the website transmits data to the user's machine which is stored into the user machine's temporary Internet files. At present, such data is sufficient to allow a single hole tour to run start to finish without drawing on anymore data from the website. In effect, a single hole tour 50 loads into the user's machine into temporary storage. A user 80 can actually go offline and continue to playback the tour 50. Of course, a user's call for another tour does require the user to be online. Anyway, the user is likely to stay online to review several tours and/or compare different golf courses. Also, if the user decides to make travel or tee reservations, check weather or download a map to the golf course, the user 80 will stay online because that can all be accomplished online.

As said, when a user browses a tour 50, the tour 50 is constructed to sequence its segments on the user 80's screen automatically, from start to end. However, the user 80 is afforded the opportunity to right click the screen, which gives the user a pop-up box containing play functions such as pause, play, back, enlarge and so on. Also, some of the views might have been acquired by IPIX camera technology, which allows Pan-Zoom-Tilt in 360°. If this is available, the controls might either be available in a pop-up box or a suitable tool bar provided somewhere on the screen.

The lower frame shows the inventive "electronic caddy" mode of use 104 of the inventive pictorial tour database 63. When a user 80 actually finds him or herself playing the golf course 70, the user might tote along a portable playback device (eg., 120, 122 and/or 124) to play the tours 50 while playing on the very golf course. In fact, the golf course 70 might encourage this by lending the necessary playback devices there for use on the course. Various playback devices would suffice, and the drawing shows at least three such options. The upper box shows an offline browser 120. This could be a portable laptop or palm-type personal computer loaded with the package 52 for that particular golf course 70 in its temporary Internet files folder. A palm-type device 120 could be easily transported in a golf cart if not more simply secured to a belt. The palm-sized devices are advancing rapidly and the future may show them shrinking in size further. The middle box shows an online browsing device 122. In this instance, the same type of portable laptop or palm-type PC's are online vis-a-vis a radio or more accurately cellular link or the like. Filtering or screening is optional. The filtering prevents broad access to the entire database. Instead, the user gets access just to that portion of the database 63 concerning the given golf course 70. The filtering would have to be enforced or installed in the device 122 under the oversight of the golf course. The purpose of filtering or screening is to keep the browsing parties from calling up other records available on the database. Golf courses want their parties to play through at a certain speed. Watching TV would impede that speed. Nevertheless, if the players can keep ahead of the pace then what difference does it make what they watch. The lower box shows other devices 124 which do not use browser technology to playback the tours. At present, this can be accomplished by, among other devices, SONY®, WATCHMAN® CD devices. Future invented devices will likely be even more capable at this. To enable a SONY® WATCHMAN®, all the service bureau need do is burn the tours into appropriate media like CD's and so on.

However accomplished, the "electronic caddy" mode of use 104 affords players the possibility of previewing each hole, indeed each shot, in advance while on the course itself.

Better than that, the electronic caddies 120, 122 and/or 124 might be equipped with GPS ("global position satellite (s)") signal-receiving capabilities. Moreover, the teaching pictorial tours 50 might further be encoded with a set of values that correspond to a mean elevation and position of say, the center of geometry of the green for that particular hole that way, the electronic caddies 120, 122 and/or 124 could give the player 80 information like the remaining yardage to the green, and the elevation differential, as measured from the present position of the electronic caddy. To turn ahead briefly to FIG. 8, this is shown better by FIG. 8.

Figure 8:
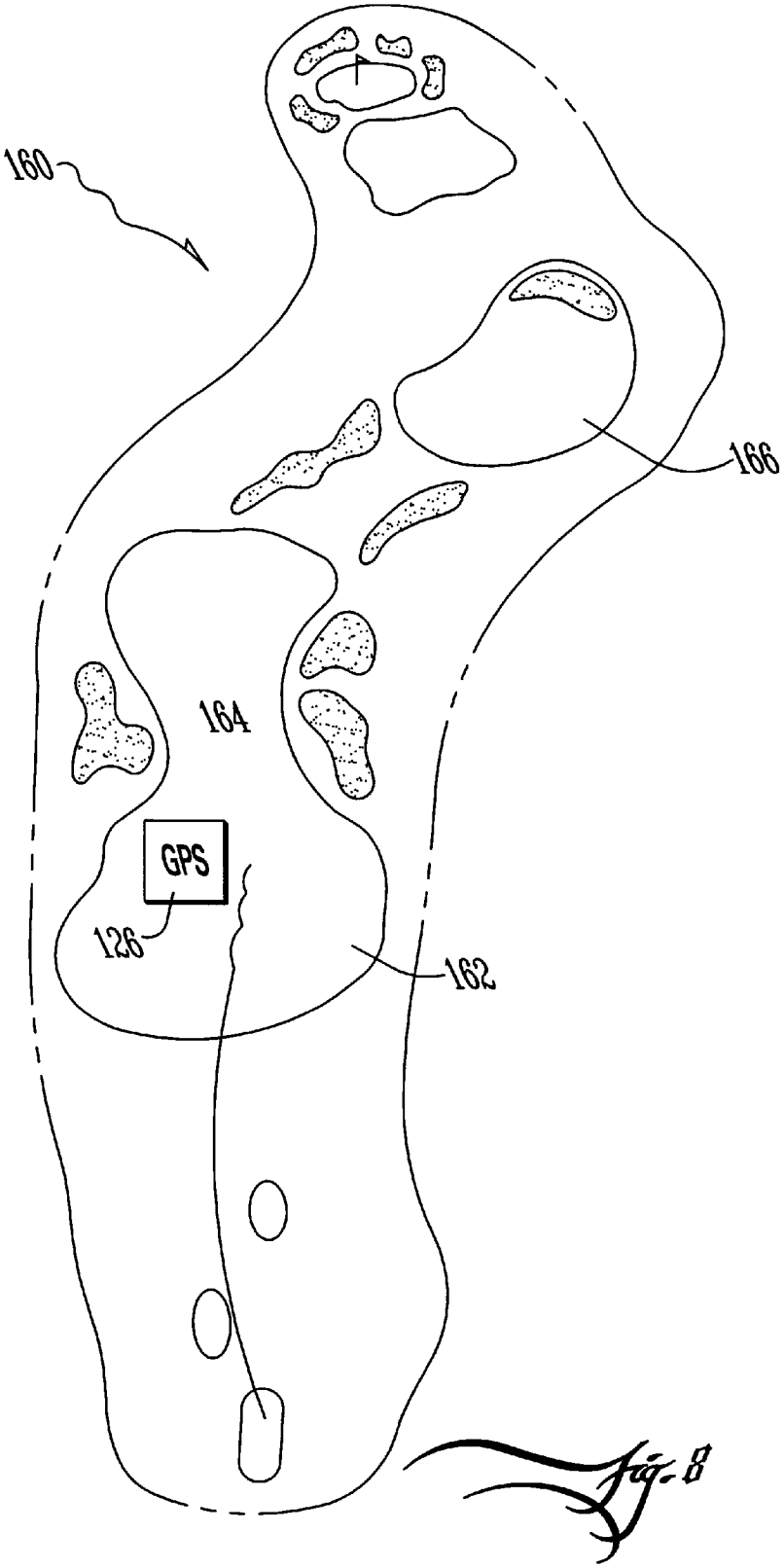
FIG. 8 is a pictorial illustration of a representative golf hole from an aerial viewpoint, wherein an imaginary ball flight is drawn in to show the problem of recommending a universal shot strategy to a diverse audience of varying skill levels, eg., whether to drive deep (not shown) or lay up short (shown)

FIG. 8 shows a hole 160 with an electronic caddy 126 positioned beside the ball placement after the first shot. This electronic caddy 126 can be any one of the electronic devices 120, 122, and/or 124 of FIG. 5. The electronic caddy 126 has a screen, the display of the green is partitioned for the concurrent display of several images simultaneously. In one area of the screen is reserved for the teaching tour 50. Another area is reserved for an plan view display of the hole as shown by FIG. 8. Smaller areas are reserved for other things, including a box for outputting written messages like 'remaining yardage', 'elevation differential' and 'club-choice suggestion', as described next. In FIG. 8, the electronic caddy 126 has GPS signal-receiving capability so that the electronic caddy 126 can determine values for its current elevation and position. The signal 50–52 provided by the database 63 also sends values to the electronic caddy 126 corresponding to the mean elevation and position of a given spot on the green (eg., the center of geometry thereof). Given those two sets of values, the electronic caddy 126 can compute the differences between them and display the remaining yardage and elevation differential in the message box. More than that, the electronic caddy can also output a club-choice suggestion for the next shot, which club-choice suggestion is looked up from a table provided by the database 63.

Another feature of the electronic caddy 126 is that, it is equipped with is a voice link back to the clubhouse, in case a player needs to call in for an emergency, or more simple place a food and beverage order.

To return back to FIG. 5, it shows more aspects of the production phase of the tours. It is an inventive aspect that the tours 50 are produced according to pre-established guidelines or "protocols" 130. The birth and lives of these protocols is somewhat recursive:—ie., these protocols 130 are established and revised in accordance with the developing experience and expertise of the service bureau 60 at producing such tours. To date, the expertise is already considerable. No doubt it is growing bigger at the same time. The protocols 130 support attaining the chosen format for the tours to the highest degree of skill and polish practical under the circumstances. Of circumstances, one limiting one is likely to be budget.

FIG. 5 shows that the process 40 of producing a tour 50 from the earliest planning stages involves considerations which have been divided into four areas:—field equipment 132 such as cameras and accessories, other field equipment 134 such as props or platforms for the cameras, the field personnel 110 (referred to as "crew" elsewhere), and, the composition protocols 130.

It is preferred that the camera equipment 132 and crew 110 be the "stock-in-trade" of the service bureau 60. Under the present organization of the inventor's service bureau 60, he and a select few others constitute the labor pool for the camera crews 110. The service bureau 60 owns much of its own camera equipment 132. This includes digital cameras for still images and action videos. This also includes lenses and filters. Needless to say, picturing a golf course takes skills learned not just simply by shooting other subjects but by particularly concentrating on shooting actual golf courses in a shot-by-shot format. These specialized skills are sharpened by trial and error experiences.

FIG. 5 allows the possibility that the service bureau 60 will negotiate with a golf course 70 if the golf course 70 wants to use its own camera equipment and crew, or else commission outside contractors to come in and do the job. Nevertheless, the inventor and his organization much prefer not to allow it to be done that way but to do the work personally.

Whoever does do it, the service bureau 60 has pre-established protocols 130 to guide the operation. It makes sense for the service bureau 60 to do the job because it has established the protocols 130 in the first place. The service bureau 60 ought to be the party most faithful at following the protocols 130. The protocols 130 are not meant to make the job impossible for anybody but the service bureau 60 (and so preserve a monopoly), but rather to ensure quality and incorporate prior learning about what makes good entertainment.

The matter of various camera platforms 134 presents a different set of considerations. The service bureau 60 owns and regularly uses some platforms 134 such as masts, booms, and low towers or scaffolding. FIGS. 3*e* and 3*h*, among others, were acquired at the end of a mast. Acquisition of flyover views requires relatively more expensive equipment. Some golf courses have a collection of aerial views that they have been willing to sell or license to the service bureau 60. These are used when they have existed. The service bureau 60 seeks to invest in a radio-controlled or remote-piloted craft. An example of one is a radio-controlled miniature helicopter and camera/video recording system known as the "TeleCopter™" vehicle of the Project Cyclops team, owned by K5MWN Cyclops RPV, as reference to http://camalott.com//cyclops/heli.html will show (the material of which is incorporated herein by this reference to it). Until that machine is bought, aerial flyover pictures are gotten by leasing that machine or hiring a helicopter or else a more affordable alternative, such as an ultra-light, a gyro-plane and/or a gyro-copter and the like. Such craft might be piloted or remotely operated, and may carry radio-controlled camera or video-recording equipment.

FIG. 5 shows that, as was described previously in connection with FIG. 4, the technical crew 110 acquires a mass of raw pictorial data 112. The engineering phase 114 is where the audio track and scrolling caption of the audio track is matched to the pictorial track. The raw data 112 is processed in an engineering studio or the like to produce a preliminary version of a finished product. The preliminary version might be viewed and reviewed for re-arrangement or inclusion of new matter. A completed product is then published by loading it into the database 63.

To once again get to the matter of the protocols 130, they have been established to preserve the knowledge gained from experience. The inventor hereof learned early on that, any tour made without effort, was viewed without joy. FIGS. 6*a* through 7*b* allow discussion of one example issue of protocol. These drawings illustrate the problem of giving depth acuity to a picture. The problem has been that, the depth acuity gotten by stereoscopic vision proves challenging to preserve in the pictures.

Figure 6A:
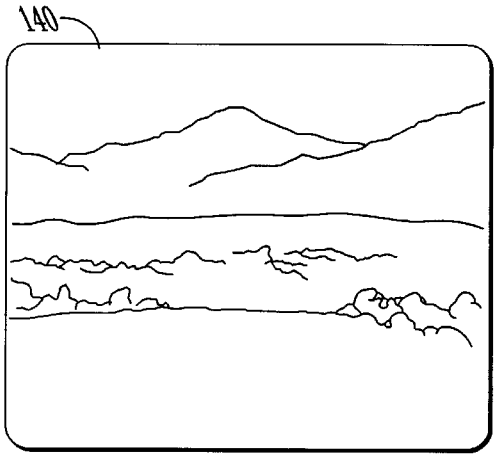
Figure 6B:
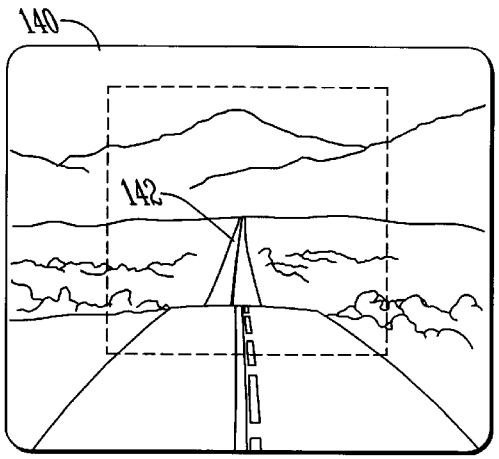
FIG. 6*b* is a view comparable to FIG. 6*a* except showing the vanishing of a highway stretching away straight ahead across the receding landscape.

FIG. 6*a* is an illustration of a landscape 140 undulating away from an origin in the foreground to hills in the background. FIG. 6*b* is a view comparable to FIG. 6*a* except showing the parallel edges of a highway 142 stretching away straight ahead across the receding landscape 140. The vanishing of the highway 142 in FIG. 6*b* provides scale for distance which is absent in FIG. 6*a*. However, it turns out that the straightway highway 142 is actually a relatively poor benchmark for depth acuity. What works better are diagonal lines stretching across any receding landscape. This is shown by FIGS. 7*a* and 7*b*.

Figure 7A:
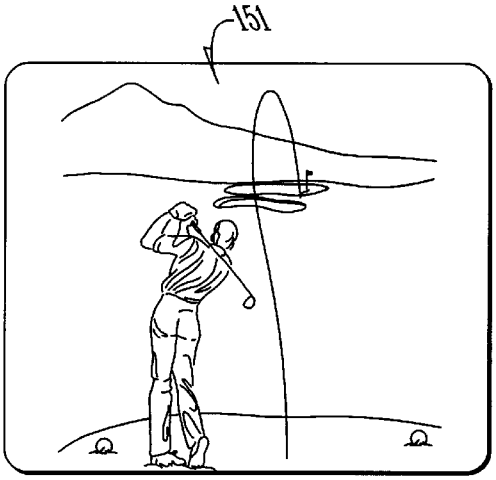
FIG. 7*a* is a pictorial illustration comparable to FIG. 1 except on a reduced scale and with the intermediary trees and water hazard removed from view.
Figure 7B:
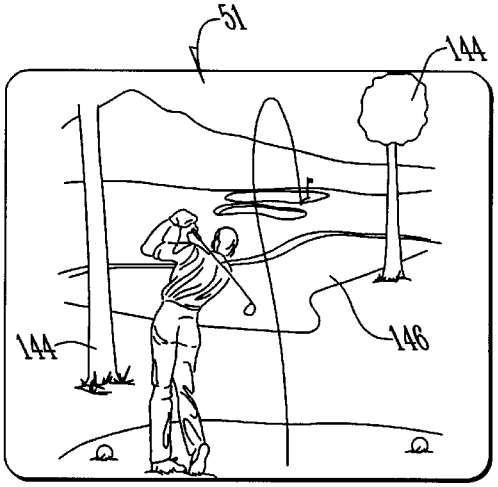

FIG. 7*a* is the artist's illustration 151 shown by FIG. 1 except that the intermediary trees and water hazard have been removed from view. The eye can clearly discern that the player stands in the foreground and that the flagstick is far in the background. It would appear if a rather rough mental estimation of distance can be judged by the relative measures of the player's bigness versus the flagstick's diminutiveness. However, such a mental estimation is really rather poor as FIG. 7*b* tends to show. FIG. 7*b* is the full version 51 of FIG. 1. The intermediary trees 144 and water hazard 146 have been added back to the view. The player's bigness and the flagstick's diminutiveness have not changed, but the mental judgement made about the distance between the two is changed. What changes this judgment is the introduction of intermediary objects which extend across the view on diagonals. In FIG. 7*b*, there are several such diagonal cues. One diagonal is defined by a line extending across where the trunks of the trees 144 rise up out of the ground. Others are defined by the water hazard 146, including its irregular shoreline.

Figure 2G:
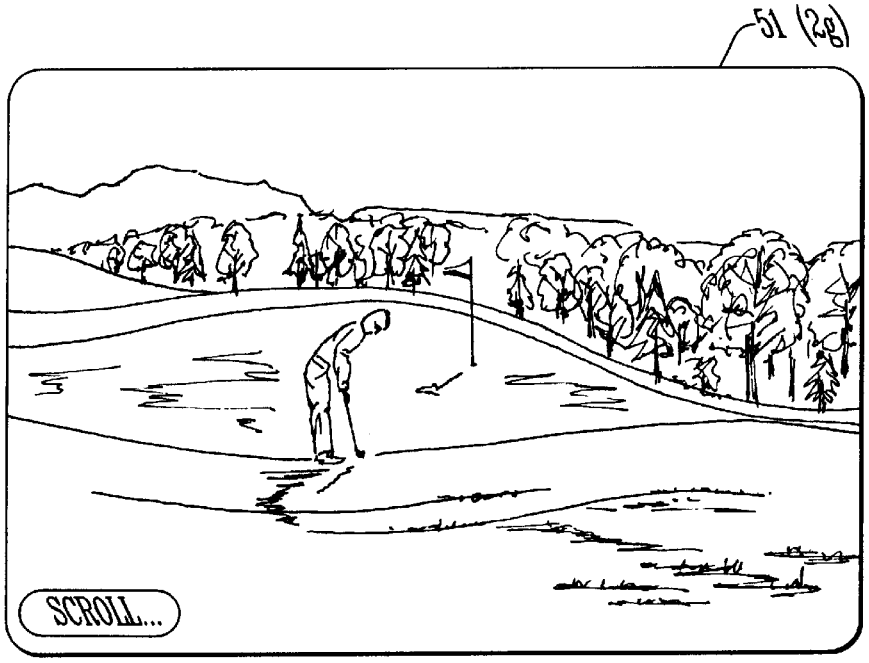
Figure 2H:
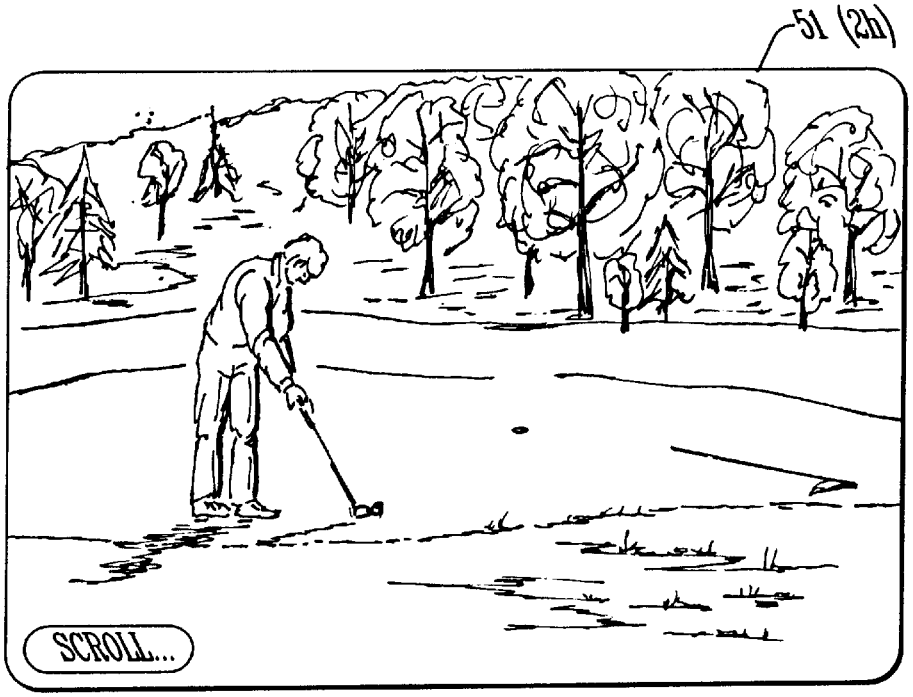

In the previous examples of FIGS. 2*a* through 2*h* or 3*a* through 3*k*, several pairs of views support this finding that:—diagonal cues help depth acuity perception. FIG. 2*c* looks down a slope where the predominant trend of the landscape is receding sets of horizontal lines. FIG. 2*d* is view turned around about 180° looking back up the slope, and in which a strong diagonal cue is defined by the trend of the trough, which trends from lower right to upper left. Hence FIG. 2*d* has a strong diagonal cue absent from FIG. 2*c*, which makes inclusion of FIG. 2*c* worthy for that aspect. FIGS. 2*f* and 2*g* allow similar comparison. FIG. 2*f* has an abbreviated diagonal cue coming in from the left edge of the view, but FIG. 2*g* apparently lacks any such diagonal cue not further than the cup.

The foregoing has all been discussed in terms of still images. With moving video, there are additional opportunities to enhance depth perception:—namely, movement with the camera as to orbit the view-object along a short arc. Say, if a camera is staged at position off the front fringe of a green at about the 8:00 o'clock position (eg., FIG. 2*f*), and then is moved in orbit around the cup to about the 6:00 o'clock position (eg., FIG. 2*g*), the action video of a changing perspective on a diagonal cue provides a very positive aid for depth acuity.

The foregoing is one lesson learned by experience. It is preserved in the protocols 130 for use and re-use both by the crew 110 acquiring the raw material as well as for the engineer(s) during studio processing 114 of the tours, for utilization where practical.

FIG. 8 shows another consideration in the production of these tours 50. Again, these tours 50 provide a recreational skill-level player with a shot-by-shot teaching of playing a given hole. "Recreational skill-level" aside, the question begged is, whose skill level? FIG. 8 shows a given hole 160. The target area for the first drive is an insular, hourglass-shaped patch 162 of fairway. The necked-in waist 164 is flanked by sand hazards. The remainder of the hourglass patch 162 is surrounded by thick rough. A long drive gets the player past the risky waist section 164. Misjudgment though, puts the player either in the rough or a sand hazard while facing a driving-iron length next shot to the succeeding target area of another insular patch 166 of fairway. Perhaps a wise alternative is to lay up short of the risky waist section 164 (as shown). All this poses a dilemma to players. The object of the tours 50 is not so much give a "one size fits all" answer to the dilemma. Rather, the tours 50 present the factors defining the dilemma, incorporate the recommendations of the course pro (or that of other worthy advisers if any, if objectively sound as measured by the service bureau's sense of soundness), and thus allow each user 80 to weigh the factors in light of that user's own abilities.

FIG. 8 also shows the advantages of aerial views. Aerial views show course width and hazards not seen from the ground. This aerial view 160 is displayed in one area of the screen of the electronic caddy 126 simultaneously as the applicable teaching tour 50 is displayed in another area on the screen thereof. Thus the view 160 shows a box (126) where the electronic caddy 126 is currently positioned on the hole of view 160. The player holding the electronic caddy 126 can find that, presently such player has yet to get past the waist 164 of the hourglass-shaped first patch 162. And, if the player is taking aim at the second patch 166, the aerial view 160 displayed on the electronic caddy 126 shows the sand hazard at the far end of the second patch 166 that might not be discernible from the ground. The views 50 given by the teaching tour 51 probably allow better resolution of immediate terrain and slope on the course, although pictorial aerial views may yield some reckoning of terrain and slope on a wider scale.

As good as they are, aerial views present a challenge not only in regards of depth acuity, but also contrast. From high above, the outlines of the insular patches 162 or 164 of the fairway may not be readily distinguishable from the rough. How to handle this depends of actual conditions. There are various tools to heighten contrast. These tools include filters to artificially widen color tone contrasts, altitude and angle of attack with the camera, angle of sunlight and so on. These are issues also addressed by the protocols.

Figure 9:
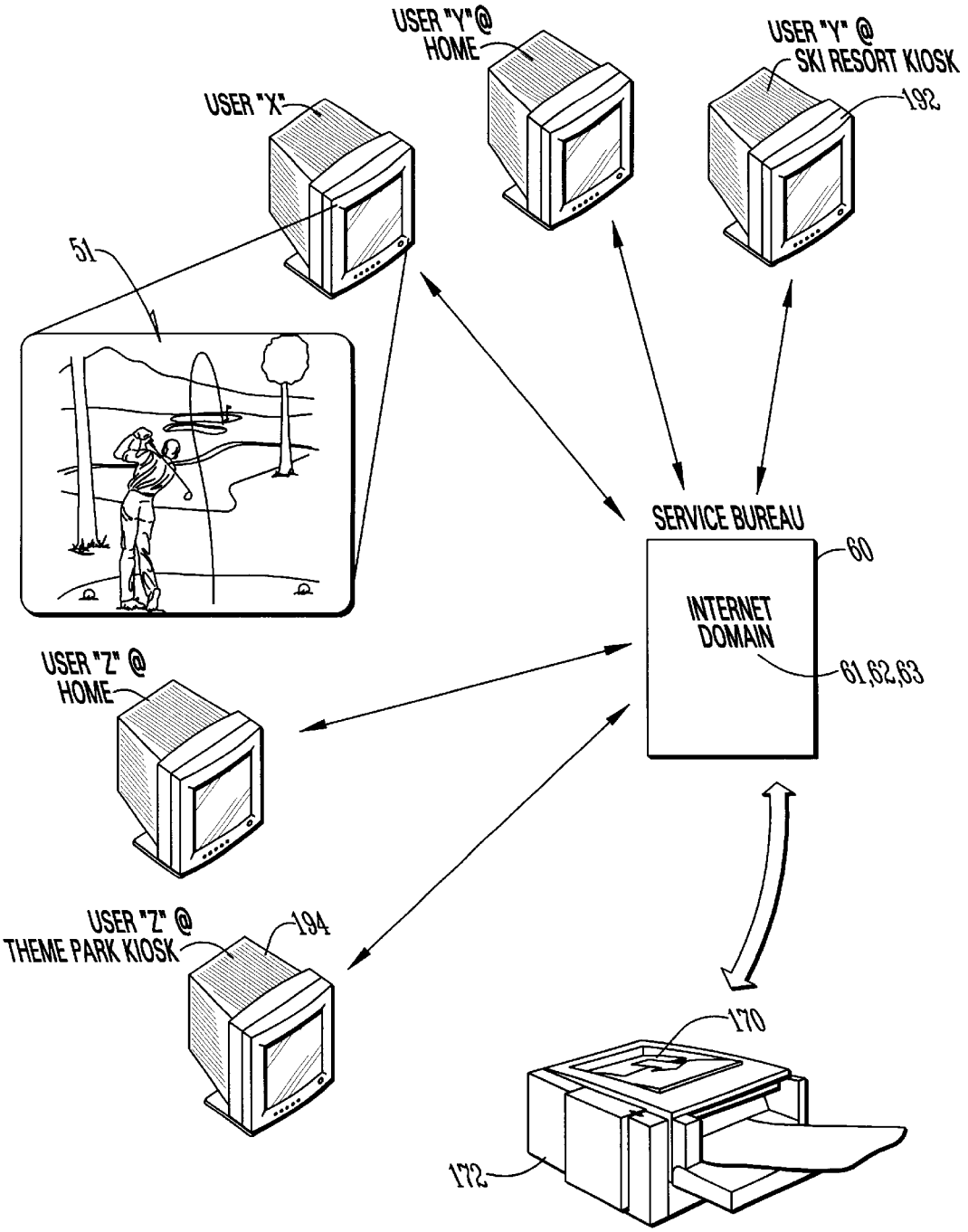
FIG. 9 is a schematic diagram view of a printing service provided by the pictorial tour authority or "service bureau" in accordance with the invention.

FIG. 9 shows many things. For present purposes, reference to user "X" (eg., 80) shows a further inventive aspect of the pictorial tour website 62 and database 63. FIG. 9 shows that if user "X" is especially fond of the view 51 as shown by for example FIG. 1, user "X" is allowed to order a hard copy 170 up to as large as a poster size print of the view 51. User "X" submits his or her order via a web transmission or else by simple e-mail. The service bureau domain 61 is equipped with both web and e-mail servers. The service bureau 60 acts on the order and prints out a hardcopy of the view in the specified size by special duty printers 172 for this purpose. The print is sent back by post to the ordering party, user "X".

The foregoing example of the service bureau 60 selling hardcopies 170 of its proprietary pictures 51 is one way the service bureau can profit by e-commerce. Two other examples include sales of CD's burned with various offered tours 50 or tour packages 52, or else electronic transfer and sale of tours 50 or tour packages 52 for use on computer-implemented screen displays as screen savers.

Figure 10:
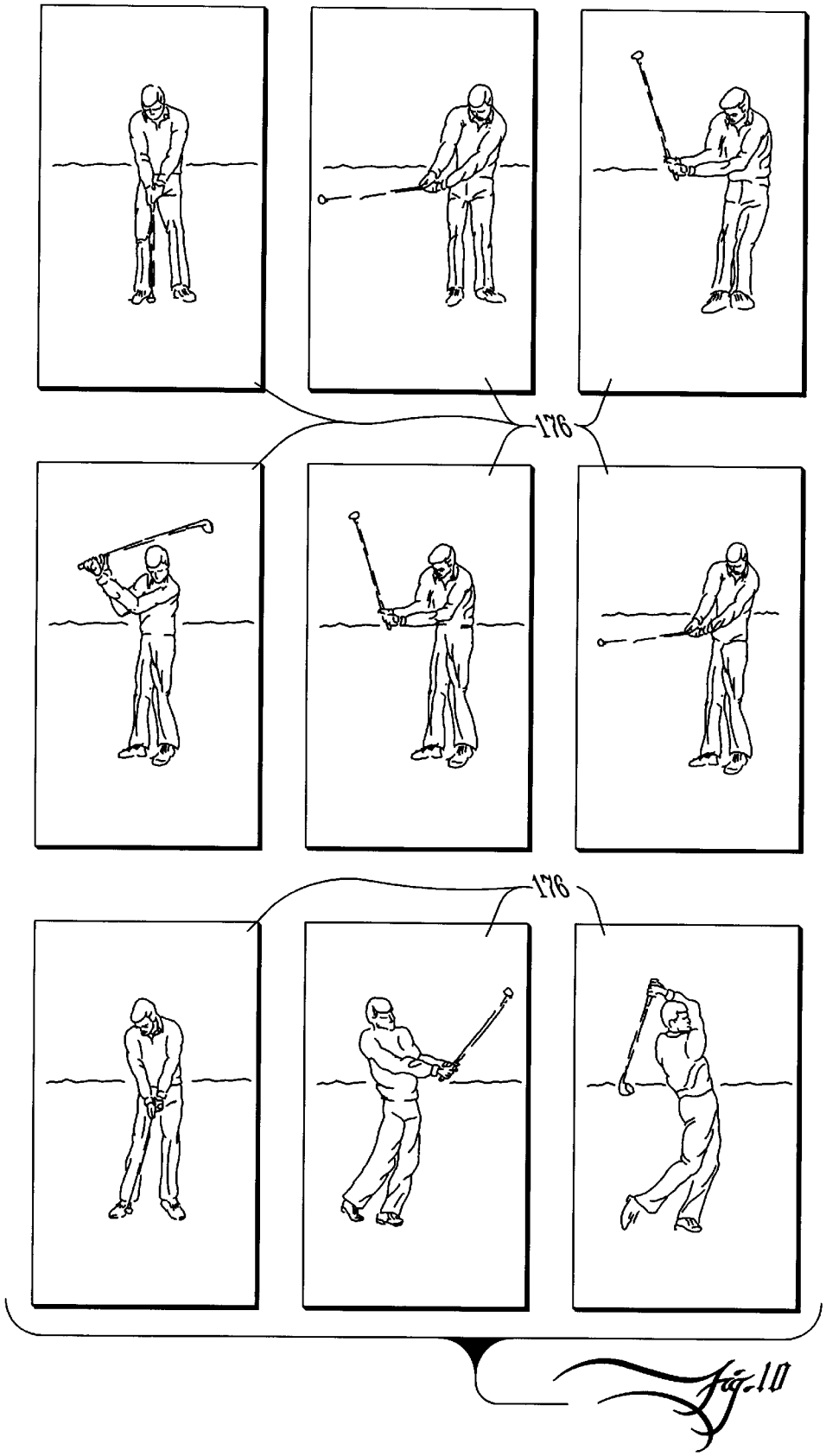
FIG. 10 comprises a series of stop action still images of a pictorially illustrated swing, wherein the aforementioned pictorial tour authority or service bureau provides digital "frame" grabbing utilities for analysis and/or printing on behalf of users/customers.

The inventive website 62 of the service bureau 60 includes a broad selection of other features, including as shown by FIG. 10, an inventive stop frame analyzer of action video. That way, as the pictorial crew visits various golf courses, they can ask willing golf pros to allow recordation of their swings for inclusion on the database. Users can call up these action videos of various golf pro swings. They can compare physical data on the golf pro to see if such is likely to make a good role model for that user. Like, what is the pro's height, does the pro have a long stroke or short stroke, quick swing speed or slow, holds arms away from the body or not? And so on. The user can then watch the video at various playback speeds to analyze the swing including fluidity or not. The inventive website is thus provided with image capturing software to create stills from digital action video. The result of which can give a series of stop-action sequences 176 of a given swing as shown by FIG. 10. Any of these images can likewise be printed by the service bureau 60 as high quality hardcopies 170 in accordance with the configuration shown in FIG. 9 for user "X". Hence the offer for sale of these views 176 is another form of e-commerce for the service bureau 60. A purchasing public exists for these views 176 both because they are teaching views as well as in some instances are likely to feature a given celebrity golfer.

Figure 11:
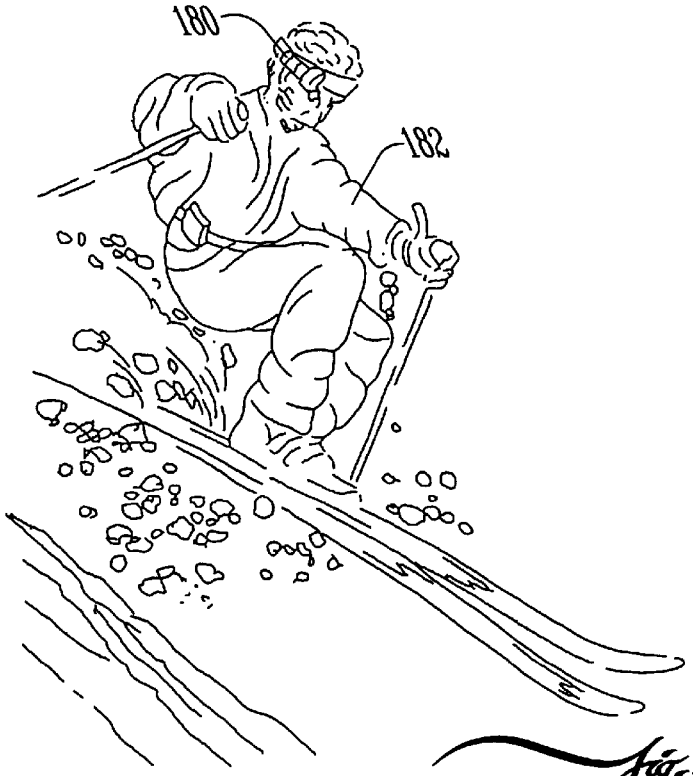
FIG. 11 shows a skier wearing a headgear-mounted digital camera for acquisition of a "you are there" perspective, pictorial ski tour in accordance with the invention; and, FIG. 12 is a view comparable to FIG. 11 except showing a kayaker wearing a headgear-mounted digital camera for acquisition of a "you are there" perspective, pictorial kayak tour in accordance with the invention.
Figure 12:
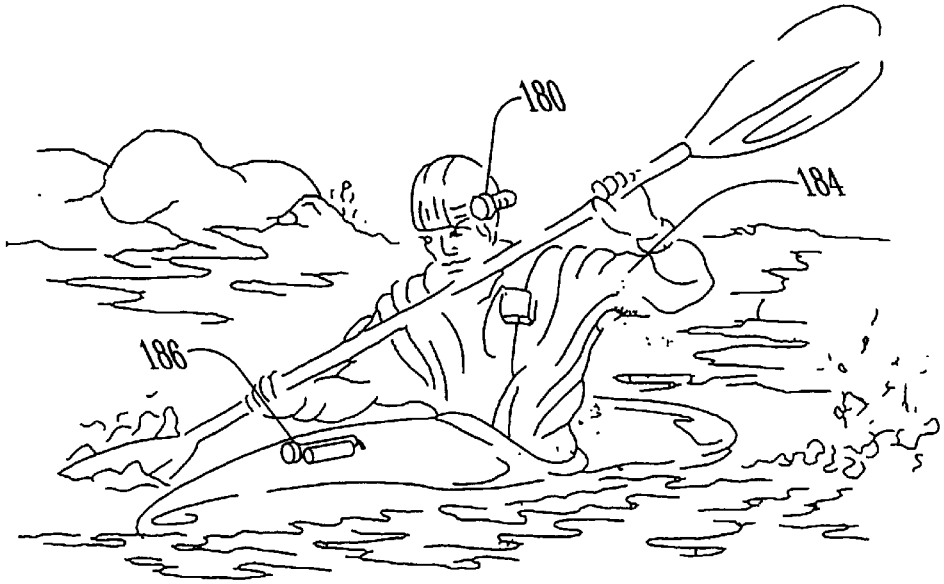

FIGS. 11 and 12 show other "field of use" applications for the pictorial tour process 40 in accordance with the invention. Applicant has a separate business venture which inventively services golf resorts, ski resorts, water sport shops, theme parks, cruise ships, and motorcycle as well as mountain bike events and so on, as more particularly described in commonly-invented, co-pending and commonly-owned U.S. patent application No. 09/133,988, filed Aug. 14, 1998, which claims the benefit of U.S. Provisional Application No. 60/055,745, filed Aug. 15, 1997, and entitled "Micro Video Camera Usage and Usage Monitoring", the disclosure of which is incorporated in full by this reference to it as if fully set forth herein.

Hence the pictorial tour process 40 in accordance with the invention allows application to various other fields of use such as skiing, as shown by FIG. 11, or water sports as shown by FIG. 12, and so on. For example for skiing, the pictorial ski tours would be constructed to give a "you are there", trail-by-trail teaching from a skier 182's perspective of all or some of the trails of a given ski resort. The tours would likewise be arranged in packages comprising episodes which may or may not comprise multiple segments. The power of the inventive pictorial tour process 40 for skiing is enhanced by views gotten from headgear worn micro cameras 180. Such camera angles provide users with actual perspective of a given route down a trail in the way that the skier 182 sees it.

FIG. 12 shows a kayaker 184 wearing a headgear worn micro camera 180 to record images for a kayak tour of a given watercourse. The headgear worn camera 180 provides a paddler 184's view of the action. Another micro camera 186 is mounted on the foredeck, and it captures the action slightly differently from the headgear worn camera 180. In each case, the skiing and water sport tours would involve a comparable construction as described above in connection with golf tours:—ie, incorporating a service bureau 60, camera crews 110, engineering studios 114, composition protocols 130 and website databases 63. In fact, the inventive pictorial tour process 40 could be applied to most or all of the diverse fields of use mentioned in the above-referenced companion patent disclosure. To name just a couple of more, this includes theme park rides and auto racing and so on.

FIG. 9 shows that the other applications (eg., fields of use) allow modification of the "electronic caddy" concept 104 into a comparable analog. Take for instance a ski pictorial tour. User "Y" researches online in the database such ski resorts she would like to vacation at. User "Y" might make reservations to do so while online. At the time user "Y" visits the ski resort, the ski resort might provide a kiosk 192 on the slopes where user "Y" can pre-view/review the trail(s) she is next likely to attack. The ski resort kiosk(s) 192 presume stationary structures. They can be equipped with online or offline browsing devices or other non-browsing all as described in connection with the lower frame of FIG. 4 (eg., devices 120, 122 and/or 124). The browsing devices can work online via cellular links and the like or work offline by local storage of as much of the ski tour database as needed. Alternatively, the user "Y" can carry a portable ski tour reviewing device such as a SONY® WATCHMAN® or the like. FIG. 9 shows that the same kind of ride preview kiosk 194 offering the same things in features might be erected in a participating theme park, and so on for user "Z" in that instance.

FIG. 9 depicts another aspect of the invention apart from the foregoing. User "Y", during her visit at the ski resort, might be recording action on her own with a given digital camera. The above-referenced companion patent disclosure particularly and distinctly describes a camera leasing method which user "Y" could avail herself to. After user "Y" has fulfilled herself with say leased camera 180 (eg., see FIG. 11), the ski resort kiosk 192 is set up with jacks to download the data of the camera 180. The camera 180's data is transmitted to the service bureau's Internet domain 61 on behalf of user "Y" on her account. The service bureau 60 can process the data into images, print the images onto hard-copies 170, or transmit the images with a suitable plug-in viewer to the e-mail or web address of user "Y". In fact, user "Y" can simply order the routing of the images to her family and friends elsewhere while she is still at the ski resort with a kind of "Look at me now" message. The service bureau 60 would be responsible for ensuring that the sockets in the digital cameras 180, jacks to the kiosks 192, and supporting software all match. That way, user "Y" never need own a digital camera 180 or the software to process digital-camera 180's data, yet get digital images sent right to wherever she wants without troubling herself again about it after leaving the ski course.

FIG. 9 shows this same construction for digital-camera data 180 input (at the given venue), digital-camera image output routed to either the service 60's printers 172 or wherever other e-mail or website address, in the context of the theme park kiosk 194 and field of use. Persons having ordinary skill in the art would be able to take the foregoing disclosure and devise a comparable construction (of digital-camera 180 input at a given golf course 70, digital-camera image output routed to either the service 60's printers 172 or wherever else user "X" might enter in as a destination) successfully for the application or "field of use" of golf. And so on for water sports, auto racing and the like.

To revisit the matter of "user-submitted" material for possible publication as a "user-submitted" pictorial tour 50", FIG. 9 allows more comments about that as follows. User "Y" can lease a camera 180, collect material during her skiing, and submit that material to the service bureau 60 vis-a-vis the ski kiosk 192 and website domain 61. The service bureau 60 can evaluate the submitted material, provided user "Y" givers her permission, for its worthiness for use and publication. The service bureau 60 might simply publish the material "as is" or send it through the engineering studio 114 to work it into a more polished product 50". It will be recognized that user-submitted material can be sought by the service bureau 60 and utilized in all the other fields of use mentioned above in connection with this inventive pictorial tour process 40.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of informative amusement with a website database containing a plurality of teaching pictorial tours of holes of diverse golf courses, comprising the steps of:

providing a website with a database having a plurality of pictorial tours, wherein each pictorial tour features one hole of a golf course, the database having pictorial tours of multiple holes of diverse golf courses;

providing a user with a machine for implementing a web browser and allowing selective playback of the pictorial tours;

providing a global computer information network for handling the transmissions between the website and the user machine;

arranging each teaching pictorial tour as an episode for continuous play from a beginning to an end and featuring a single hole, each episode comprising a series of scenes, sequenced together for automatic playback from beginning to end, which series of scenes are taken from a corresponding series of staging areas comprising at least:

one staging area around the tees looking down the target line over the fairway to a prospective first-shot target zone for the original shot off the tee, as from a player's perspective;

another staging area around the first-shot target zone looking either rearwards back to the tees or forward ahead to a second-shot target zone; and a further staging area around the greens looking back up the fairway; and then, allowing a user to choose any episode for playback vis-a-vis the user's machine and browser; and, allowing the user informative amusement with playback of the given single-hole episode, the user being limited in the informative amusement with the given single-hole episode by the content such that the pictorial tour only gives shot-by-shot evaluative information respecting the play of the hole by excluding promotional content for promoting the golf course as well as excluding golf-lesson content respecting general lessons on skills for playing the game of golf applicable to any hole, whereby the user is freed of extraneous content that diverges from informing the user respecting the shot-by-shot strategy how to play the hole and so allows the user to see himself in the context of his play through the hole vis-a-vis playback of the given episode.

* * * * *